US006977585B2

(12) United States Patent
Falk et al.

(10) Patent No.: US 6,977,585 B2
(45) Date of Patent: Dec. 20, 2005

(54) MONITORING SYSTEM AND MONITORING METHOD

(75) Inventors: Dietrich Falk, Tokyo (JP); Takashi Hosoda, Kanagawa (JP); Chu Hui Chu, Tokyo (JP); Boyd Weston, Tokyo (JP)

(73) Assignee: Sony Corporation, Tokyo (JP)

( * ) Notice: Subject to any disclaimer, the term of this patent is extended or adjusted under 35 U.S.C. 154(b) by 248 days.

(21) Appl. No.: 10/616,246

(22) Filed: Jul. 9, 2003

(65) Prior Publication Data

US 2004/0113770 A1 Jun. 17, 2004

(30) Foreign Application Priority Data

Jul. 11, 2002 (JP) ..... 2002-203213
Sep. 11, 2002 (JP) ..... 2002-265836

(51) Int. Cl.[7] ..... G08B 29/00
(52) U.S. Cl. ..... 340/506; 340/3.1; 340/539.25
(58) Field of Search ..... 340/506, 3.1, 517, 340/539.11, 539.25

(56) References Cited

U.S. PATENT DOCUMENTS 6,049,273 A 4/2000 Hess
6,052,052 A * 4/2000 Delmonaco ..... 340/539.11
6,147,601 A * 11/2000 Sandelman et al. ..... 340/506

FOREIGN PATENT DOCUMENTS

DE 196 21 152 11/1997
GB 2 329 541 3/1999

* cited by examiner

*Primary Examiner*—Daryl C Pope
(74) *Attorney, Agent, or Firm*—Frommer Lawrence & Haug LLP; William S. Frommer

(57) ABSTRACT

To provide a monitoring system and method that allows customization of a monitoring system and method according to a user's instruction, thereby achieving a higher flexibility in configuring the monitoring scheme. The monitoring system comprises a user system and a security server. The user system includes a capture unit, an input unit, a sensor, an imaging unit and a home server. The home server accepts the user's instructions and configure monitoring program realized by the home server. The user may specify logical connections between imaging unit and sensor, notification rule when the alarm is occurred.

50 Claims, 19 Drawing Sheets

MONITORING SYSTEM AND MONITORING METHOD

CROSS REFERENCE TO RELATED APPLICATIONS

The present document is based on Japanese Priority Application JP2002-203213, filed in the Japanese Patent Office on Jul. 11, 2002, and JP2002-265836, filed in the Japanese Patent Office on Sep. 11, 2002, the contents of which being incorporated herein by reference to the extent permitted by law.

BACKGROUND OF THE INVENTION

1. Field of the Invention

The present invention relates to a monitoring system and a monitoring method. More specifically, the present invention relates to a monitoring system and a monitoring method for home security and/or safety purposes.

2. Related Art

Nowadays, there is an increasing demand for household or home security, not only as a countermeasure against of violation of private property, but also for safety in house against fire, gas leakage, quakes and the like. There is also an increasing demand for remote monitoring of house activity, especially for households having small children, elderly people or pets.

A method for remotely monitoring and controlling a home security system is disclosed, for example, in U.S. Patent Publication US 2001/0034586 A1, Japanese Laid-open JP 2001-189814 and JP 2001-76273, in which electronic devices located at a property are remotely monitored and/or controlled.

Japanese Laid-open JP 2000-99862 discloses a system including a home server and various sensors including a plurality of cameras. The system detects an intruder by using a sensor and stores image data before and after the detection of the intruder.

Japanese Laid-open JP 2000-235688 discloses a system including a sensor, camera, network connecting unit and controller. When the sensor or camera detects an event such as break-in, the controller send a preset message that may include image data to a security service business operator, police station, another PC terminal, or a user's cell phone via Internet or telephone net.

SUMMARY OF THE INVENTION

There is however a drawback in the above described systems and method of the related art. In such systems, monitoring schemes implemented in the systems and methods are in predetermined formats, and are not designed to allow the user to configure the monitoring schemes according to his/her requirement. It is desirable to provide a monitoring system and method that allows customization of the monitoring system and method according to user's instructions, thereby achieving higher flexibility in configuring the monitoring scheme. It is desirable to provide a monitoring system and method that allows a user to set up arbitrary relation between various imaging sensors and non-imaging sensors thereby enabling to create a preferable form of alarm notification signal suited for the user's need.

Also, security information and customer data has to be sent to an external server that pertains to a single security service business operator that manages the information if a customer decides to receive monitoring service from such security service business operator. However, there is security concern for sending his/her private information to a third party such as the security service business operator. It is desirable to keep the security data and other private information related to the user including personal data under strict control of a trustful party. Further, it is desirable to send the security data and other private information only if they are required. Furthermore, it is preferable to provide a monitoring system and method that eliminates direct connections between a user and the monitoring or security service business operators as much as possible.

Further, user's requirement or preference for the monitoring or security service may change over time. Accordingly, it is preferable to provide a monitoring system and method that allows the user to deal with a plurality of monitoring or security service business operators.

In configuring a monitoring system, it is preferable to leverage resources in user's home such as a home server, a personal computer, or any other apparatus with a CPU so that such home resources may be utilized as a part of the monitoring system. Further, it is preferable to provide a device that stores and transfers monitoring software to an apparatus with a CPU to expanding the apparatus to be one of main constituent elements of the monitoring system. In order to accommodate flexible configuration of the monitoring system, it is preferable to provide a device that interfaces the arbitrary number of sensors and an apparatus that processes the sensor outputs in the monitoring system.

It is preferable to provide a monitoring system and method that allows a user to arbitrary select alarm data that should be transmitted and a destination of the selected alarm data. Furthermore, it is preferable to provide a monitoring system and method that allows a user to control actions of the monitoring system after an alarm is issued.

The present has been conceived in view of the problems described above. According to an embodiment of the present invention, a monitoring method is provided. The monitoring method may be applied to a system including a plurality of sensors, a plurality of imaging units and a storage unit. The monitoring method may comprise: receiving of outputs from the plurality of sensors and the plurality of imaging units, and transmitting of a notification signal to a preset destination if one of the received outputs is in alarm status that needs to be reported based on a preset alarm criterion. The notification signal includes at least one of image data outputted from the plurality of imaging units that is associated with the sensor of the alarm status, and the association among the plurality of sensors and the plurality of imaging units is pre-determined in accordance with a user's input and stored in the storage unit.

According to another embodiment of the present invention, a monitoring method is provided. The monitoring method may comprise receiving of outputs from the plurality of sensors, and transmitting of a notification signal to a preset destination if one of the received outputs is in an alarm status that needs to be reported based on a preset alarm criterion. The notification signal includes contact instruction information that define if another notification signal corresponding to the notification signal is transmitted to another destination from the preset destination receiving the notification signal, and the contact instruction information is generated based on notification rule that is determined in accordance with a user's input and stored in the storage unit.

According to still another embodiment of the present invention, a method for assisting monitoring activity performed in a user's designated location using a plurality of sensors, and transmitting a notification signal if one of the plurality of sensors is in alarm status, the method being performed by a server disposed in a separate location from the user's designated location. The method may comprise receiving of the notification signal including contact instruction information transmitted from the user's designated location; generating of another notification information corresponding to the received notification signal; determining of another destination of the other notification signal based on the received contact instruction information; and transmitting of the other notification signal to the determined other destination.

According to still another embodiment of the present invention, a monitoring system is provided. The monitoring system may include a plurality of sensors, a plurality of imaging units, a control unit for determining if a notification signal should be transmitted and a transmission unit transmitting the notification signal to a preset destination. The monitoring system further comprises a storage unit storing logical connections among the plurality of sensors and the plurality of imaging units, and a setup unit receiving a user's input and setting the logical connections in accordance with the received user's input. The control unit generates the notification signal if one of the plurality of sensors is in alarm status, and determines if the notification signal includes image data outputted from the imaging unit that is logically connected to the sensor in the alarm status, and the transmission unit transmits the notification signal as determined by the control unit.

According to still another embodiment of the present invention, a monitoring system is provided. The monitoring system may comprise a storage unit storing notification rule that is used to generate contact instruction information defining if another notification signal corresponding to the notification signal should be further transmitted to another destination from the preset destination, and a setup unit receiving a user's input and setting the notification rule in accordance with the received user's input. The control unit generates the notification signal if one of the plurality of sensors is in alarm status, and generates the contact instruction information for the generated notification signal, and the transmission unit transmits the notification signal including the contact instruction information to the preset destination.

According to still another embodiment of the present invention, a capture unit that may be included in a monitoring system is provided. The capture unit may be connected to a plurality of sensors, a plurality of imaging units and an apparatus having a computer. Furthermore, the capture unit may include a receiving section receiving parallel data from the plurality of sensors and the plurality of imaging units, a buffer storing at least a part of image data outputted from the plurality of imaging units, and a transmitting section for transmitting serial data to the apparatus. Here, the serial data corresponds to the data received from the sensors and the imaging units. The capture unit may further comprise a storage section storing a monitoring program for controlling operation of the apparatus to realize a monitoring system, an interface section transmitting the monitoring program to the apparatus. The transmitted monitoring program is executed by the apparatus to realize the monitoring system.

According to still another embodiment of the present invention, a server is provided. The server, which receives a notification signal from a plurality of user's monitoring apparatuses, may comprise: a receiving unit receiving notification signals from the plurality of user's apparatuses, each of the notification signals including contact instruction information that defines if another notification signal corresponding to the received notification signal is transmitted to another destination, a processor generating the other notification if the notification signal is received, analyzing the contact instruction information included in the received notification signal, and determining the other destination to which the generated other notification signal is transmitted in accordance with the analysis result, and a transmission unit transmitting the other notification signal to the determined other destination.

In the server described above, the storage unit may further store charging data for each of the user's monitoring apparatus for use of service provided by the present server, and the processor may update the charging data in accordance with communications to the user's monitoring apparatus. The charging data includes charging amount calculated based on a number of times the receiving unit receives the notification signal, period of time spent by the receiving unit to receive the notification signal, a number of times the transmission unit transmits the other notification signal, period of time spent by the transmission unit to transmit the other notification signal or data volume of at least one of the received notification signal and the transmitted other notification signal.

The above described monitoring methods may be realized by a computer program, which may be stored in any type of storage medium.

According to still another embodiment of the present invention, it is preferable to provide a security server that is capable of communicating with a plurality of home servers and performing various functions preset by way of receiving instructions from an individual home server, instructions such as storing data from registered users, sending alarm to users and communicating several security service business operator's monitoring terminals.

In addition, the conventional systems includes either dedicated devices or programs that are executed or run on personal computers. A security server disclosed in the conventional system accepts connections from specific devices. It would be preferable if the security server could interact with a plurality of home servers, and each home server running the security application.

Conventional security service business operators (security companies) provide proprietary security systems and each security company runs its own security server including user data such as name, address, ID, etc. It is preferable to provide a security server between the security company and the home servers. This would enable the user to choose a security company. The security server will consider the different features and data formats of the monitoring stations at the security companies when passing information from the home devices to the monitoring stations.

The security server according to the present embodiment may be controlled and managed by a business operator that is separated from the security service business operator providing the security service. That is, the business operator that takes action, for example, sending an agent or informing a public authority (police, etc.) to the site of alarm, upon receiving notification of security information such as the alarm notification.

According to still another embodiment of the present invention, it is preferable to provide a security control program executed by an apparatus installed in the user's residence (e.g. a home server) to receive user operation and configure detail structure/functionality/operation condition of a home monitoring system to be used according to the user operation providing that the apparatus has a processing resource (a processor, memory and the like) and data storage. The details to be configured may include logical connection of non-image sensor and image caption (or imaging) unit, data storage scheme (when and where the data should be stored), etc.

In addition, it is preferable to provide a capture unit having a memory for storing a security control program and an interface unit (or loading unit) for downloading the security control program when an apparatus which has capability to run the security control program is connected. Instead of including only a dedicated apparatus for exclusive purpose of monitoring, such apparatus may be a conventional information processing apparatus available at the house, such as a processor included in a personal computer, a game console, an entertainment robot, an audio or video apparatus, an electric appliance or a terminal apparatus.

Also the capture unit may accept data from a plurality of sensors and devices and sending the captured data (which would be described below in terms of alarm data) to the apparatus (e.g. home server) that executes the security control program.

Moreover, it is preferable to provide a method of charging a user who receives service performed by the security server, which, as described above, is controlled neither by the user neither by the security service business provider.

According to the preferred embodiments of the present invention, it is possible to provide a monitoring system and method that allows customization of the monitoring system and method according to a user's instruction, thereby achieving a higher flexibility in configuring the monitoring scheme.

BRIEF DESCRIPTION OF THE DRAWINGS

The above and other features and advantages of the present invention will become more apparent to those skilled in the art from the following description of the present exemplary preferred embodiments of the present invention taken in conjunction with the accompanying drawings, in which.

DESCRIPTION OF THE PREFERRED EMBODIMENTS

A detailed description of a monitoring system and a monitoring method according to preferred embodiments of the present invention is provided below, with reference to the attached drawings.

Monitoring System: First Preferred Embodiment

Figure 1:
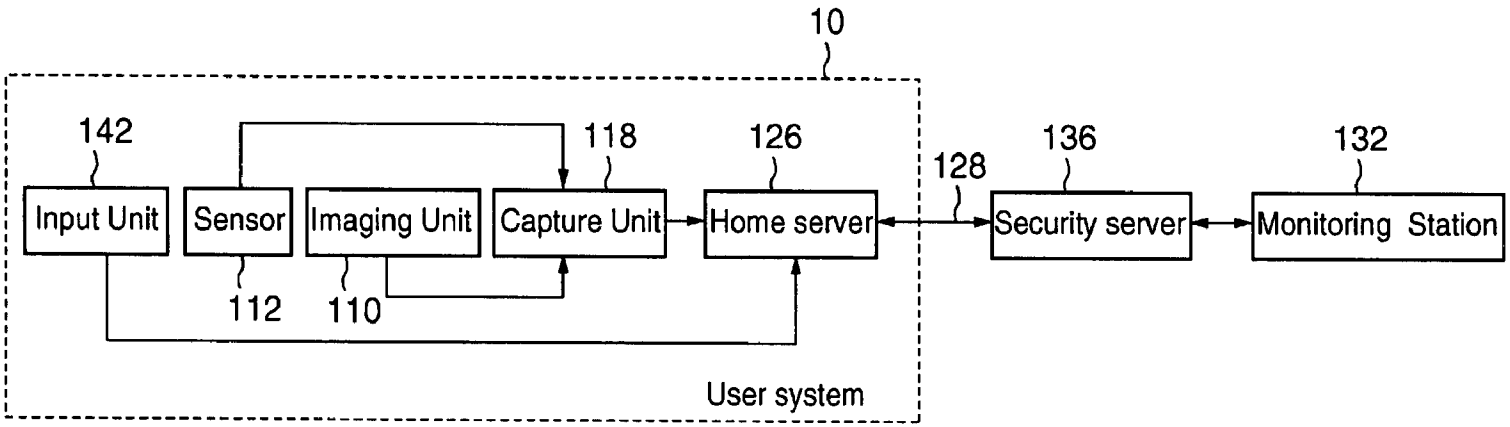
FIG. 1 is a schematic block diagram showing an example of the monitoring system according to a first preferred embodiment of the present invention.

FIG. 1 shows a schematic block diagram of a basic configuration of a monitoring system according to a first preferred embodiment of the present invention. The monitoring system of the present embodiment comprises a user system 10 and a security server 136. The user system 10 includes a capture unit 118, an input unit 142, a sensor 112, an imaging unit 110 and a home server 126.

The sensor 112 comprises a plurality of sensing devices. The sensing devices may be any detector such as a smoke detector, a fire detector, etc, and outputs a status signal of physical quantity to be measured. Alternatively, a device outputting a signal proportional to a measured level of the physical quantity such as a microphone, light sensing detector, etc may also be employed. If such device is used, a threshold detector may be employed together with such device. The threshold detector determines whether if a level of output signal from the device is above a preset level or not, and outputs a status signal according to the determination result.

The imaging unit 110 comprises image capturing devices such as cameras or camcorders and outputs image data. Alternatively, the imaging unit 110 may output image data as well as audio data.

Figure 2:
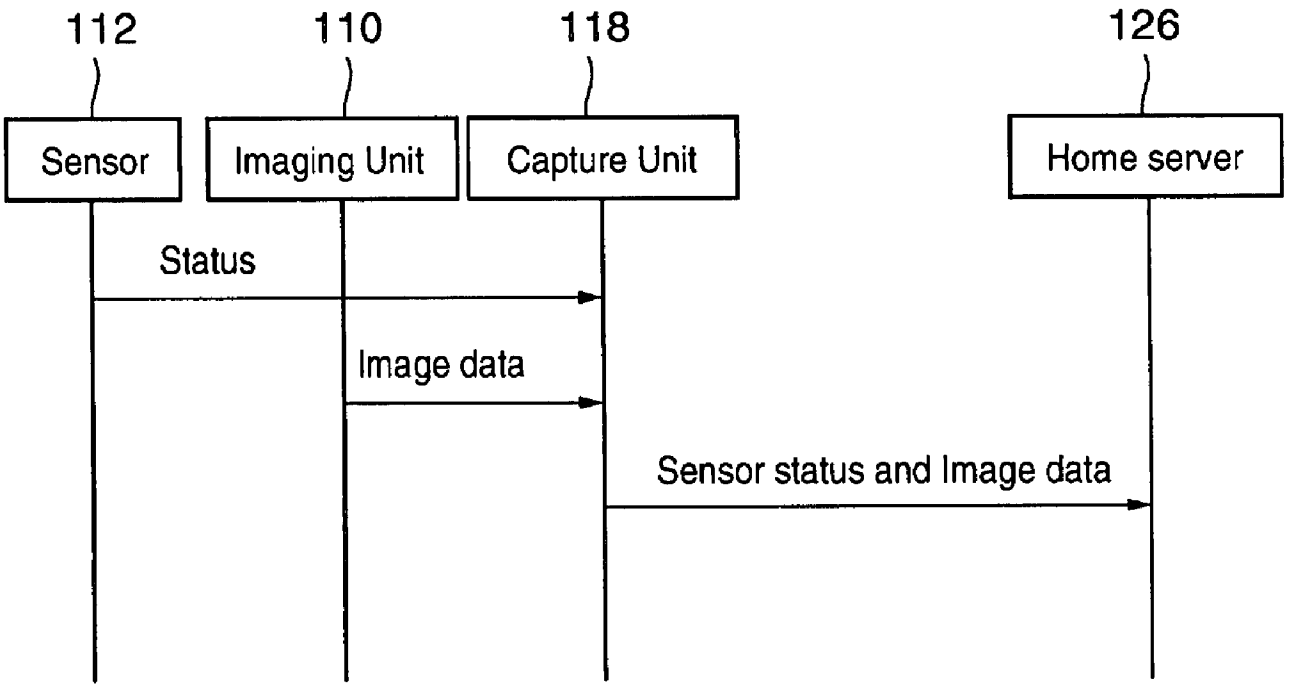
FIG. 2 is a schematic view illustrating the types of data to be transmitted from the sensor and the imaging unit to the capture unit and the home server.

The capture unit 118 is an apparatus for receiving signals from the sensor 112 as well as image data from the imaging unit 110, converts the received data to a designated format and sends or transmits the converted data to the home server 126 as shown in FIG. 2. Thus, the capture unit 118 serves as an interface unit between the home server 126 and the inputting unit including the sensor 112 and the imaging unit 110 through a communication path that may be either wired or wireless. As it is clear from the above description of the sensor 112 and the imaging unit 110, data inputted to the capture unit 118 may be the status data of sensing device, image data (motion picture or still image), audio data (if the sensor is, for example, a microphone or other kind of vibration sensor) or the like, and may be either in analog or digital form.

The capture unit 118 may establish conversion of inputted analog data to digital data by means of an A/D (Analog to Digital) converter provided therein (not shown in the figure). Also, a digital signal may be converted to an analog signal by means of a D/A (Digital to Analog) converter (also not shown) before being transmitted to an external apparatus, if required to do so. It is to be understood that any or both of the A/D and D/A converters may be alternatively located in the home server 126 instead of the capture unit 118. Also, the capture unit 118 may be alternatively included as part of the home server 126.

The input unit 142 is a means by which a user can control and set the present monitoring system. The input unit 142 transmits instructions to the home server 126. The home server 126 receives the transmitted instructions and sets functionality realized by computer programs executed by the home server 126.

The home server 126 includes at least a processor and memory for executing programs (called security program hereafter) to realize a monitoring method according to an embodiment of the present invention. The security programs cause the home server 126 to transmit monitoring information to the security server 136 through a communication link 128 that may be either a wired or a wireless means. The home server 126 may store the data transmitted from the capture unit 118.

Figure 3:
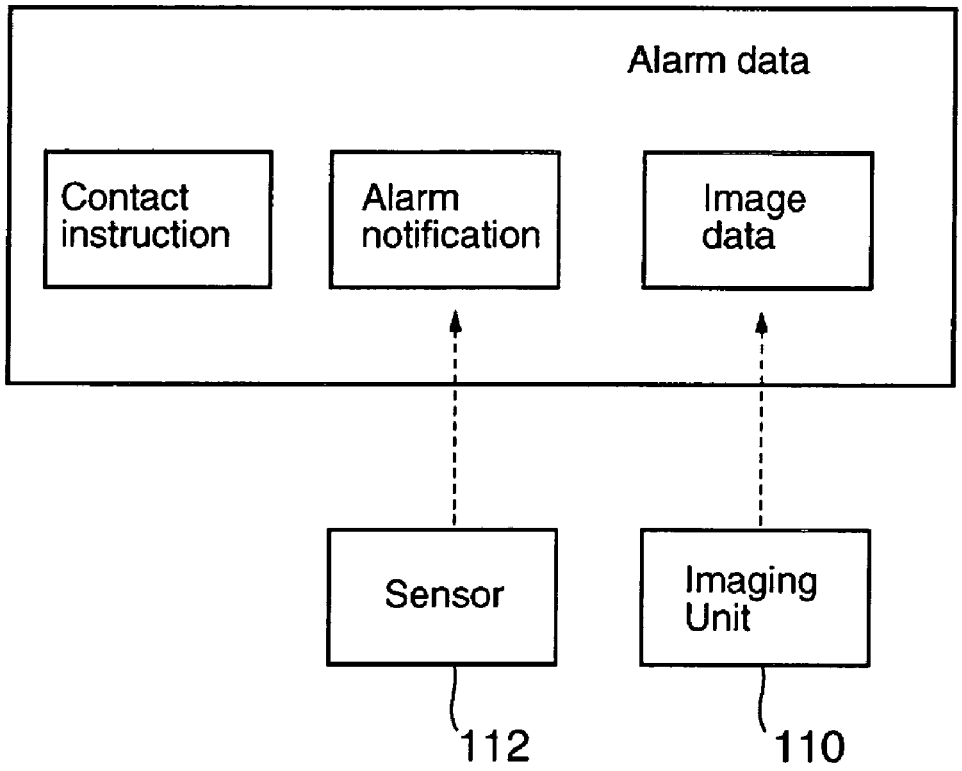
FIG. 3 is a schematic diagram showing configuration of the alarm data.

The monitoring information may be referred to below as "alarm data". As shown in FIG. 3, the alarm data may include "alarm notification" corresponding to a signal or status signal from the sensor 112, "image data" from the imaging unit 110 captured by the capture unit 118, and "contact information" that is data instructing how the alarm notification and the image data should be processed in the security server 136. For example, only the alarm notification may be transmitted to the monitoring station 132 independently from the associated image data from imaging unit 110, if the contact information contain a instruction to only send the notification data (an alarm) without showing the image captured by the imaging unit 110. The alarm data to be transmitted may be determined based on the settings configured by the user via the input unit 142, for example.

The home server 126 and the security server 136 are separate server machines executing the security programs. According to the security program described in detail below, only selected alarm data such as alarm notification data, image data and notification instructions is sent from the home server 126 to the security server 136. In the security server 136, the received alarm data is further selected and only the alarm data that needs to be responded by the third party managing the monitoring station 132 will be sent to the monitoring station 132. These selections of the alarm data carried out in the home server 126 and the security server 136 are performed in accordance with the setting of the present monitoring system.

Figure 4:
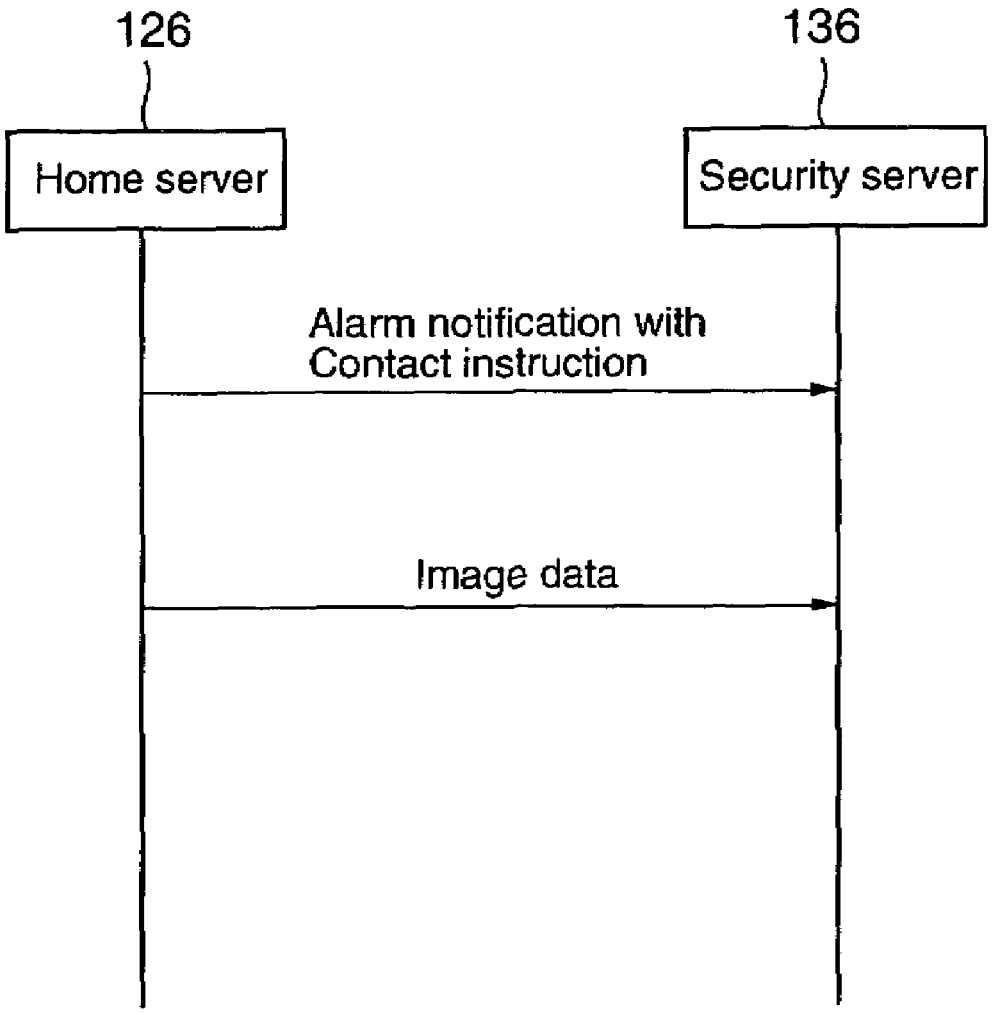
FIG. 4 is a schematic diagram illustrating the types of data to be transmitted from the home server to the security server.

The security server 136 is located at a remote place in relation to the home server 126 and may be a repository of alarm data from a plurality of home servers 126 (i.e., a plurality of households, not shown). As shown in FIG. 4, the alarm data may include a contact instruction by which destinations and contents of the alarm data is defined, thereby enabling the security server 136 to send the alarm data to the destinations of the user's choice when the alarm is set off.

The security server 136 may be administrated by a monitoring business provider that in the preferred embodiment of the present invention is a business operator that differs from a security service business operator that controls the monitoring station 132. As a result, the security server 136 may be connected to a plurality of security service business operators, typically a plurality of security companies. The fact that the alarm data is not under control of a single security service business operator allows flexibility for the user to change the business operator without having to change his/her own system configuration that are installed in the user's house. This increases the user-friendliness of the entire monitoring system and also contributes to cost reduction for both user and business operators.

An example of the security programs executed in the home server 126 and the security server 136 will be described below with reference to FIGS. 5–8.

The setting of the present monitoring system is achieved by a system setup operation performed in the home server 126. The system setup operation comprises the following steps as shown in a flowchart of FIG. 5. The input unit 142 may be used to input data or commands during the system setup operation.

First, the home server 126 checks if an input is for the initial setup or not when it receives the input from outside in step 600. If this is the initial setup, the home server 126 accepts appropriate user's input and, according to the accepted inputs, setups a user profile and a hardware profile of the instant monitoring system in step 602. The profiles may include user's name, user's ID, information related to the sensor 112 and the imaging unit 110 or the like.

In step 604, a relationship (logical connection) between the sensor 112 and the imaging unit 110 is determined in accordance with the user's input. Such determination is especially significant when there are plural sensing devices and plural imaging devices. Specifically, one or more sensing devices are associated with one or more of the imaging devices. Alternatively, some of the sensing device may be associated with no imaging device. For example, the logical connection is established between a smoke detector placed in a kitchen and a camera overlooking kitchen, thereby enabling collection of image data if an alarm of the smoke detector is set off.

In step 606, alarm criteria of the sensor 112 are determined. Specifically, an alarm threshold level or a condition by which the alarm is recognized for each sensing device of the sensor 112 is set in accordance with the user's input. If the sensing device outputs only On or Off of the alarm signal, the alarm criterion may not be determined. Further, not only single sensing device but also a combination of the sensing devices may be taken into consideration to judge a particular type of alarm.

In step 608, a notification rule is determined. The notification rule defines (i) amount of the image data to be sent out; (ii) destinations of the alarm data or the monitoring information; and (iii) contents of the alarm data to be sent out. The amount of the image data to be sent out may be defined by setting a time period before and after the alarm set off.

For example, one of the following notification rules may be selected.

(1) All of the alarm data are stored locally (at home) with notifications sent directly to a designated destination by the home server 126. The notification may include the image data as well as the alarm notification data. Alternatively, the user may have access to the alarm data directly if the home server 126 is constantly turned on and may be connected to from the outside;

(2) The alarm data is sent to the security server 136 from the home server 126. The alarm data may be stored both on the home server 126 and the security server 136; and (3) In addition to (2), the alarm data is sent from the security server 136 to the monitoring station 132 and stored therein.

More specifically, an alarm signal or a signal level higher than preset threshold sent from one of the sensing device in the sensor 112 via the capture unit 118 may trigger the home server 126 to cause transmission of image data and record into the security server 136, or may trigger storing of the alarm notification and the image data locally. The transmitted image data may correspond to a period of time previous to the activation of the sensing device as well as image data corresponding to a period of time after the activation of the sensing device. As a result, it is possible to establish a log or record on evidence of causes of alarm for further study, for example.

In step 610, the monitoring station 132 to which the alarm data is sent from the security server 136 is selected according to the user's input if a plurality of security service business operators are available. This allows the user to select the monitoring station 132 of his/her preference and change as he/her wish without having to notice the security service business operator managing the monitoring station 132.

Alternatively, if concerning security information is notified to a plurality of security service business operators, the operator with highest availability to take any proper action against the notification may be activated, thus allowing optimizing or minimizing the time required for taking action, such as sending a patroller to the concerning site so as to verify the causes of alarm.

If it is not judged as the initial setup in step 600, the process advances to steps 612, 614, 616, 618, 620 according to a type of the user's input. If the user's input indicate changes of the personal or hardware profile, the logical connections, the alarm criteria, the notification rule and the monitoring station selection, the process advances to an appropriate step.

Figure 5:
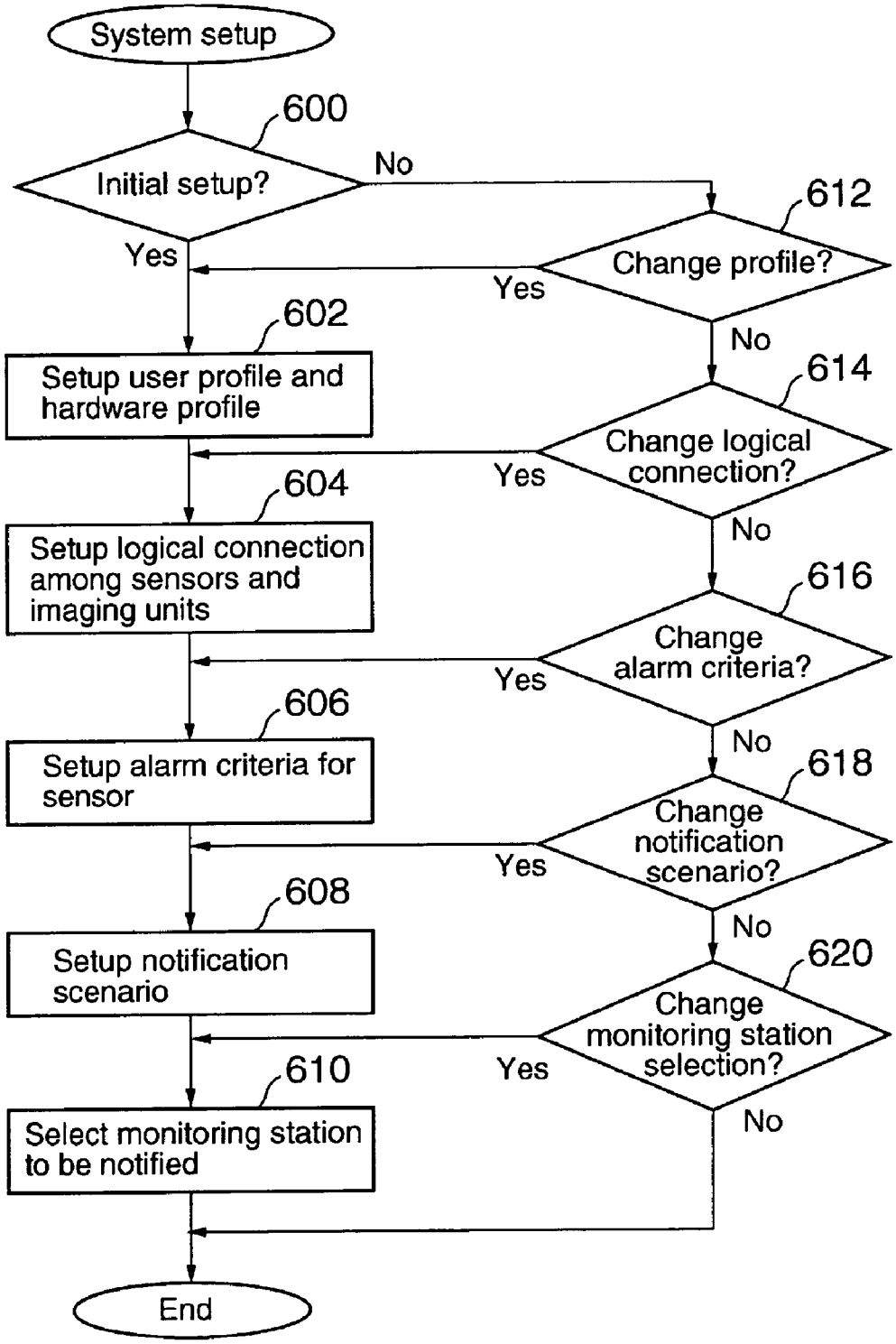
FIG. 5 is a flowchart of processing steps for the setting operation to configure the monitoring operation according to the first preferred embodiment.

Alternatively, the above described steps may not be necessary to be executed in an exact order as shown in FIG. 5. The setting of the profiles, the logical connections of the sensor 112 and the imaging unit 110, the alarm criteria, the notification rules and the selection of the monitoring station 132 maybe performed in a different order. Further, other setup steps may be added in the system setup operation if necessary, and some of the above step may be eliminated by using a default setting or the like.

Figure 6:
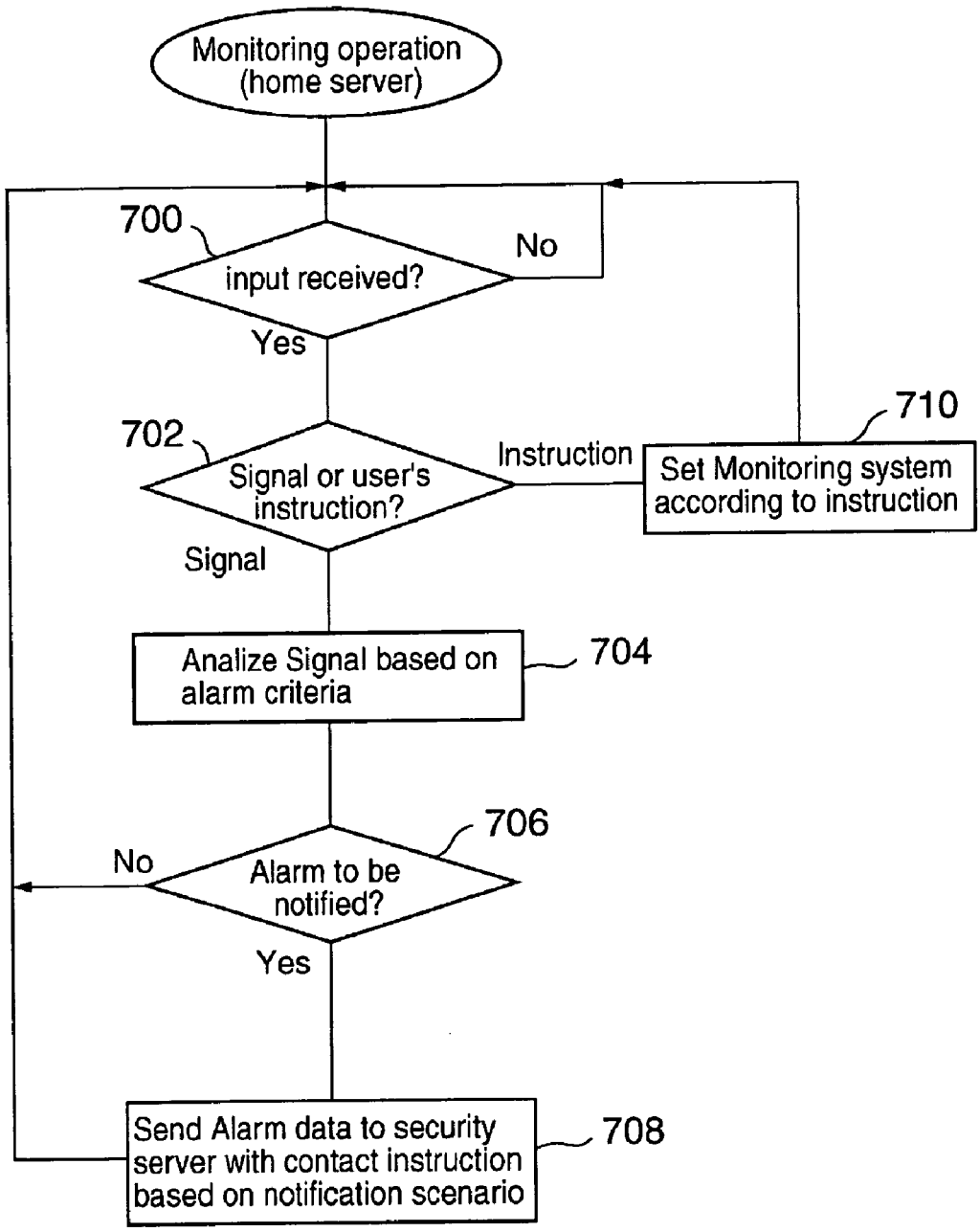
FIG. 6 is a flowchart of processing steps for the monitoring operation performed at the home server according to the first preferred embodiment.

An example of the monitoring operation performed by the home server 126 will be described with reference to FIG. 6.

If an input is received from an external device, the received input is analyzed whether if the input is a signal from the sensor 112 or an instruction signal sent from the user via the input unit 142 (steps 700, 702). If the input is the signal from the sensor 112, the signal is further analyzed according to the alarm criteria defined during the setting of the instant monitoring system in step 704.

If the signal is indicating an alarm status need to be notified, an alarm notification is transmitted to the security server 136 with contact instruction as well as the corresponding image data if applicable. The contact instruction and whether the image data should be sent with the alarm notification are determined based on the notification rule, which is defined during the setting of the instant monitoring system (steps 706, 708).

The contact instruction may include a user information for identification of the instant alarm data and an instruction indicating how the instant alarm should be handled in the security server 136. For example, the contact instruction may define whether if the instant alarm data should be only recorded in the security server 136, or transmitted to the user, or transmitted to the user and the monitoring station 132, etc.

If it is judged that the signal from the sensor 112 does not correspond to the alarm need to be notified in step 706, the instant operation procedure returns to step 700.

If it is judged that the input is the instruction signal from the user in step 702, an appropriate setting of the instant monitoring system is performed based on the received instruction in step 710. The instruction may include activation/deactivation of the monitoring system, change of the system setting, etc. After the appropriate setting is completed, the monitoring operation procedure returns to step 700 and wait another input.

Figure 7:
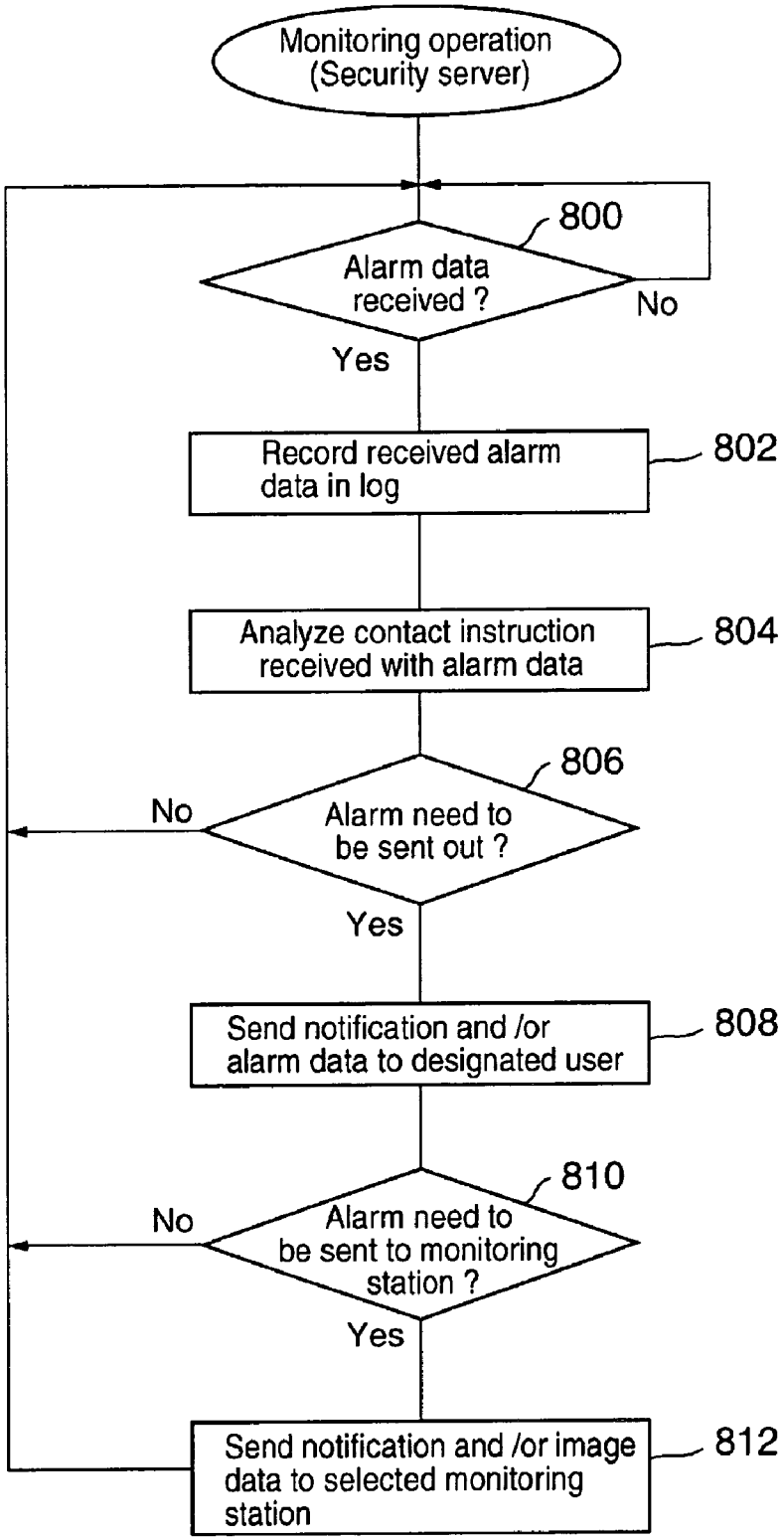
FIG. 7 is a flowchart of processing steps for the monitoring operation performed at the security server according to the first preferred embodiment.

An example of the monitoring operation performed by the security server 136 will be described with reference to FIG. 7.

The monitoring operation in the security server 136 may be triggered by receiving the alarm data that includes at least alarm notification and contact instruction transmitted from the home server 126. If such alarm data is received in step 800, the received alarm data is recorded in a log that is maintained and managed by the security server 136 in step 802.

In steps 804, 806, the contact instruction included in the alarm data is analyzed to determine whether if the instant alarm data should be sent out from the security server 136 or not. If it is determined that transmission of the alarm data is unnecessary, the monitoring procedure returns to step 800. If the alarm data. needs transmission, only the alarm notification or the entire content of the alarm data is transmitted to a designated user or location according to the contact instruction in step 808.

In step 810, the contact instruction is further analyzed to determine whether if the instant alarm data should be transmitted to the monitoring station 132 or not. If it is determined that transmission of the alarm data is unnecessary, the monitoring procedure returns to step 800. If the alarm data needs transmission to the monitoring station 132, only the alarm notification or the entire content of the alarm data is transmitted to a monitoring station 132 of the user's choice according to the contact instruction (step 812). After completing step 812, the monitoring procedure returns back to step 800.

The contact instruction may include a user information for identification of the instant alarm data and an instruction indicating how the instant alarm should be responded by the security service business provider managing the monitoring station 132. Such instruction regarding the response may include sending a security agent to the user's house where the alarm is originated, calling an appropriate public service such as police or hospital, or the like.

Figure 8:
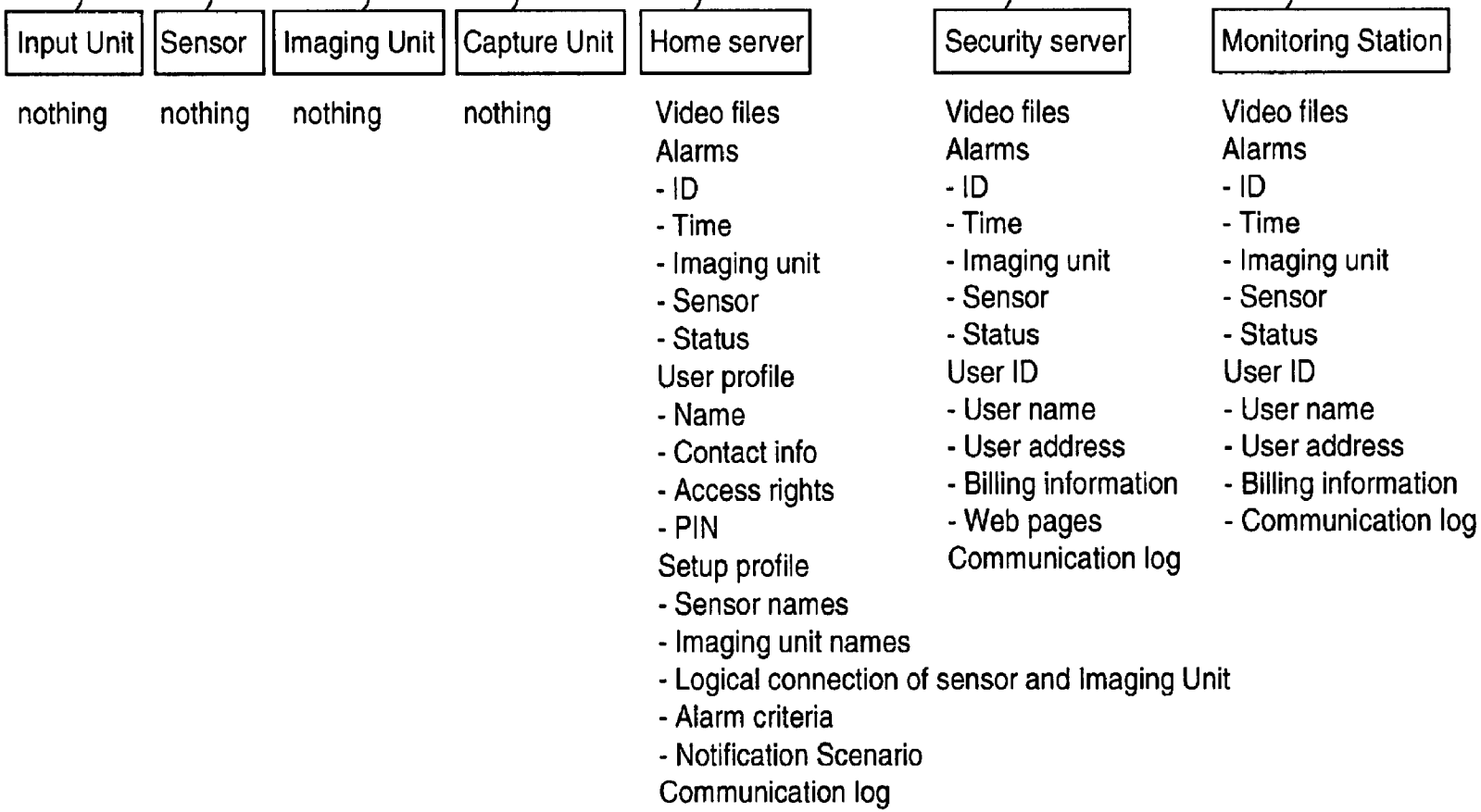
FIG. 8 is a schematic diagram showing data stored in various apparatuses in the first preferred embodiment.

FIG. 8 shows a brief description of an example of types of data that may be stored in the functional units described above with reference to FIG. 1. It is to be noted that user's personal data or user profile is not stored at the security server 136, but only the minimum data required for identifying the user and place to be monitored is stored in the security server 136, such as user ID, user name, user address and billing information. The user may be identified by the security server 136 through a personal identification number (PIN) or password. Also, the monitoring station 132 at the security service business operator stores only data necessary for recognition of the user and records on alarm data, such as image files or the like, if applicable.

Monitoring System: Second Preferred Embodiment

Figure 9:
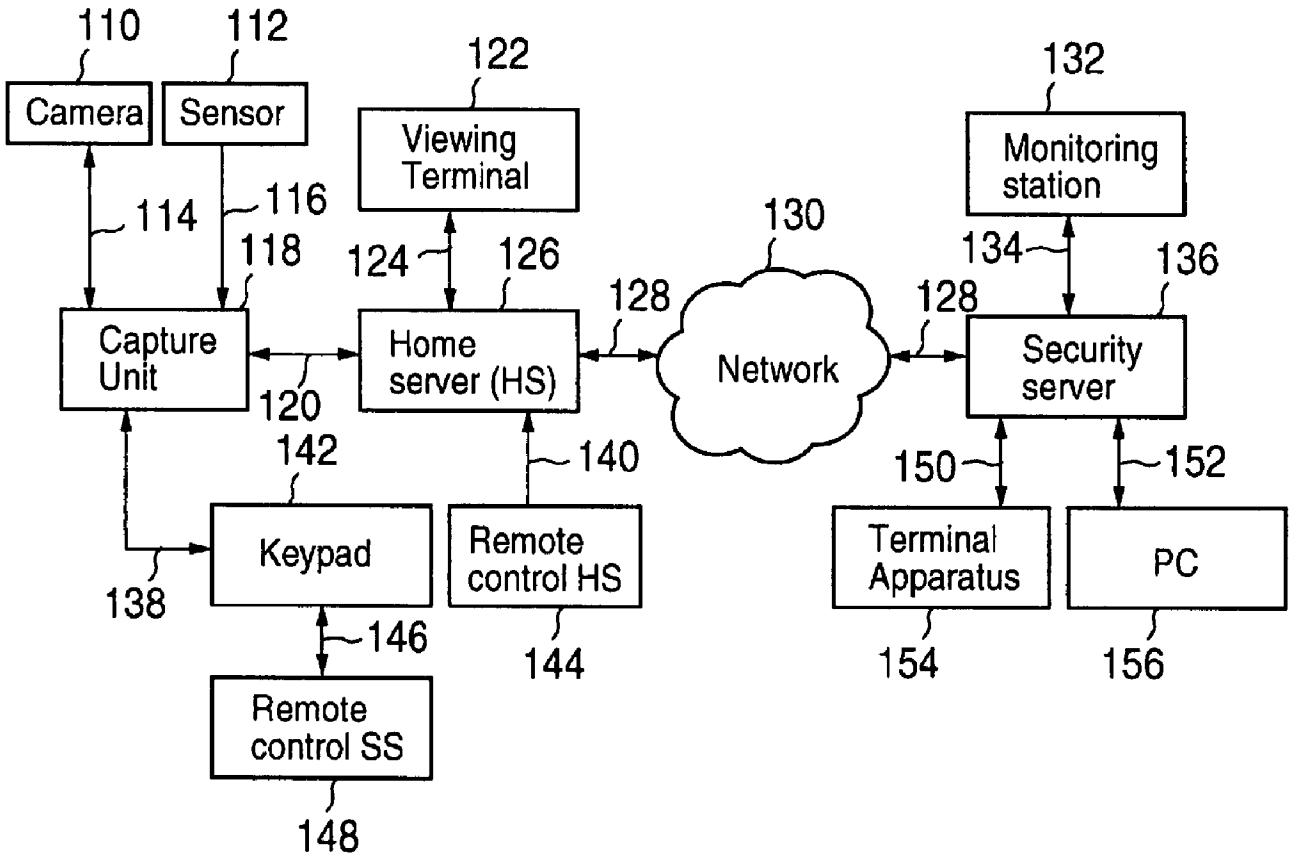
FIG. 9 is a schematic block diagram showing an example of the monitoring system according to a second preferred embodiment of the present invention.

An overview of a monitoring system according to a second preferred embodiment of the present invention is schematically illustrated in FIG. 9.

As shown in FIG. 9, the monitoring system includes the following main components: a set of cameras 110, a set of sensors 112, a capture unit 118, a viewing terminal 122, a home server 126, a keypad 142, a remote controller 144, a second remote controller 148 and a security server 136. The home server 126 and the security server 136 are connected via a network 130.

The security server 136 communicates with terminal apparatuses 154, personal computers (PCs) 156 and monitoring stations 132 and sends information relating the monitoring activity according to the present embodiment. The terminal apparatuses 154 and PCs 156 may be operated by the user of the home server 126 or a person designated by the user to receive alarm notifications or view the alarm data through the security server 136. It is to be understood that same reference numbers as that of the first embodiment are used to designate corresponding components.

The set of sensors 112 has at least one sensor that may include, for example, a smoke detector, a movement or motion detector, heat detector, gas sensor, carbon monoxide detector, a breaking glass detector, humidity detector or the like. A signal that is sent by any sensor 112 to the capture unit 118 may indicate a change in status that generates an alarm message or notification, or even activating another apparatus or device as a response to the signal. The sensors 110 report alarms to the capture unit 118 over a wired or wireless communication channel 114 by sending an appropriate signal resulting from activation thereof.

The cameras 110 may constantly send image data to the capture unit 118, even when there is no event or change in status detected by any sensor 112.

The capture unit 118 may encode and multiplexe an input from the sensors and cameras onto a single output data stream and sends it to the home server 126 over a wired or wireless communication channel 120. Alternatively, multiple signal and data may be sent in a serial format over the communication channel 120. If a camcorder capable of outputting video and audio data is implemented instead of the camera, the audio data may be encoded with video image data and sent to the home server 126.

The capture unit 118 maintains a video buffer for each connected camera and constantly updates the buffers with the latest image data from the cameras. If the capture unit 118 receives an alarm notification (signal) from one of the sensors, the alarm notification and the image data from one or more cameras (as specified by the user) will be sent to the home server 126. In other words, any of the cameras 110 may be associated to one or more sensors 112, as specified by the user and in a customizable or changeable manner. The user may also configure the home monitoring system such that the image data from any camera 110, either with or without alarm signal, is also sent to the security server 136 over a communication link 128.

Interaction with the home server 126 is performed through an application program (not shown) running, for example, on the home server 126 by using the remote controller 144 and the viewing terminal 122, together functioning as an interface between the user and the monitoring system that is configured by the home server 126. The viewing terminal 122 may be a display apparatus available at home such as a TV monitor, a computer monitor or the like and may be a CTR (cathode ray tube), a LCD display or the like.

The keypad 142 may be used to perform basic interactions with the monitoring system of the present embodiment via the capture unit 118. The keypad 142 is typically a simple input device with, for example, a display that is installed close to the house's entrance door.

The remote controller 148 may be typically a device or apparatus that the user carries when leaving the house. The remote controller 148 may send basic instructions to the keypad 142 over a wireless communication channel 146 and be used, for example, to arm or disarm the instant monitoring system from outside the house or a remote position from the house.

A more detailed description of portions of the system according to the second preferred embodiment of the present invention is described as follows.

Capture Unit

Figure 10:
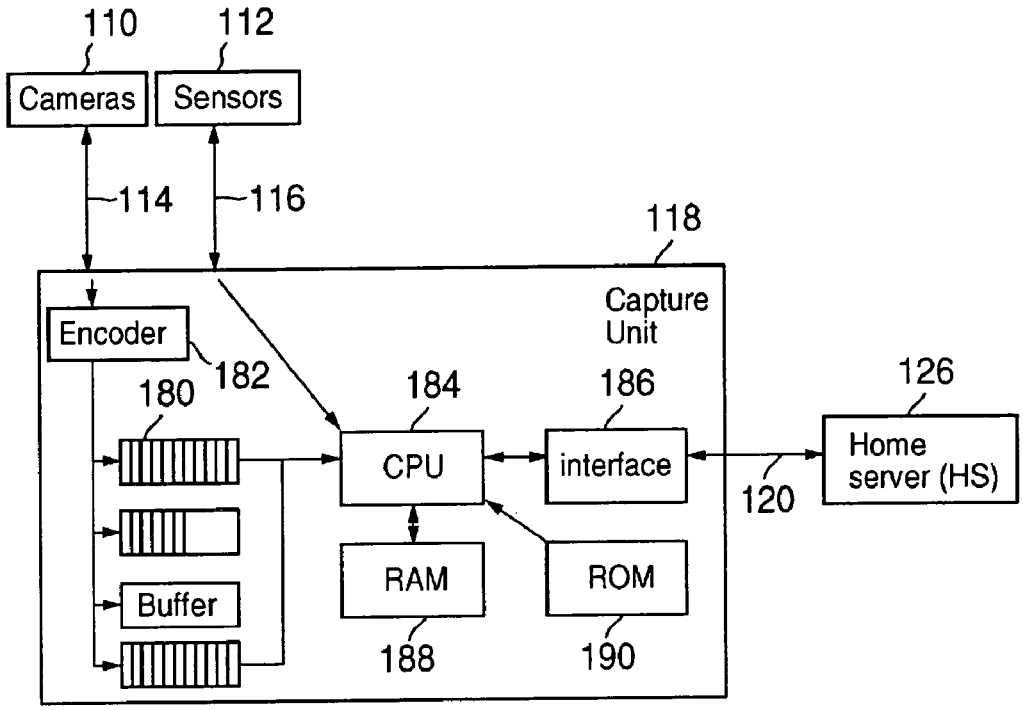
FIG. 10 is a schematic block diagram showing an example of the capture unit in the monitoring system of FIG. 9.

A block diagram for an example of the capture unit 118 is shown in FIG. 10. The capture unit 118 runs a program that is stored in ROM 190. During program execution, CPU 184 may use RAM 188 for processing. Data such as or image data from the cameras 110, for example, is transferred through a path 114 to an encoder 182 in the capture unit 118 where it is encoded.

Although a type of the encoding is not limited in the present invention, it is preferable to use the encoding scheme such that the encoded image data is easier to transmit over the network and easier to view on various types of display terminals.

For each camera, image data can be stored in a buffer 180. The buffer 180 is kept up-to-date with the latest data from the cameras 110. In case of an alarm from one of the sensors 112, an alarm notification and the image data from one or more cameras 110, as setup previously either as a default setting or as determined and setup by the user, is sent over an interface 186 to the home server 126.

Alternatively, the signals from the sensors 112 and the image data from the cameras 110 may be sent to the home server 126. In this case, the home server 126 determines if any of the sensor signal is indicating an alarm status, and identifies the image data corresponding to the sensor in the alarm status.

The image data sent from the capture unit 118 to the home server 126 may be comprised of, for example pre-alarm image data and post-alarm image data. The image data stored in the buffers 180 represents the pre-alarm image data. The post-alarm image data is the image data sent from the camera(s) to the capture unit 118 after the alarm.

Home Server

Figure 11:
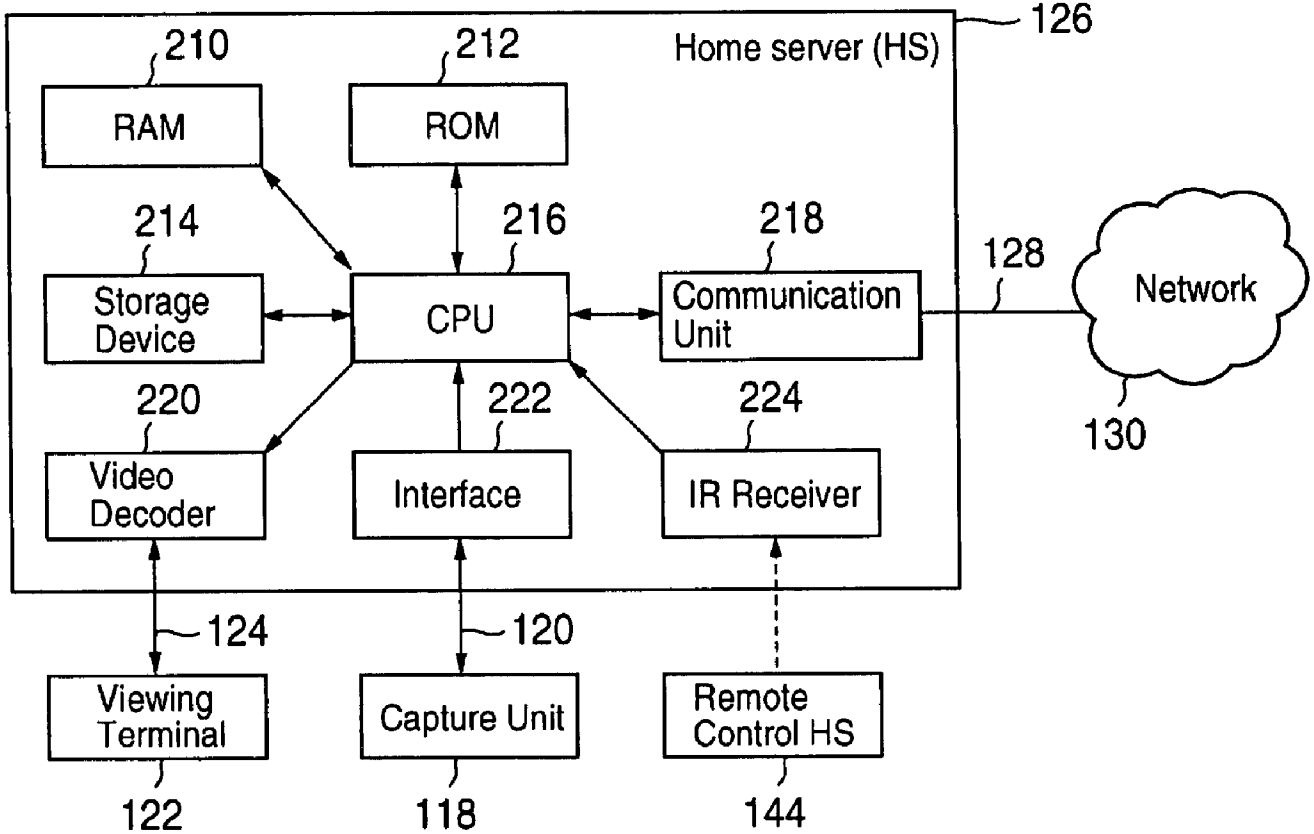
FIG. 11 is a schematic block diagram showing an example of the home server in the monitoring system of FIG. 9.

Now, a block diagram of the home server 126 is shown by reference to FIG. 11. The home server 126 comprises a CPU 216, RAM 210, ROM 212, storage device 214, video decoder 220, interface 222, infrared (IR) receiver 224 and communication unit 218. The storage device 214 may be a magnetic, optical, magneto optical medium, such as for example a hard disk, a tape, an optical disk or any combination thereof.

It is preferable that the home server 126 allows simultaneous recording and playback of several video and audio data streams. The video and audio data streams are typically encoded using an appropriate encoding standard such as MPEG (Moving Picture Experts Group), for example.

The home server 126 receives alarm notifications and video streams (image data) from the capture unit 118. When the home server 126 receives video streams through an interface 222, image data is stored in a buffer (not shown).

For each alarm that may occur, the user may specify the time period of pre and post alarm image that should be stored on the home server 126. The total of the pre alarm period and the post-alarm period specifies the amount of image data that will be stored onto the home server 126. For each alarm it is possible to specify if the alarm data should also be sent to the security server 136 and/or the monitoring station 132. Both options might only be available to subscribers to a monitoring service provided through the system according to the preferred embodiment of the present invention.

The user can furthermore specify how he should be contacted when an alarm occurs. The user can for example specify one or more electronic mail addresses and/or telephone numbers to be called. The home server 126 or the security server 136 will then try to contact the user according to the contact instruction provided in advance. The alarm notifications and the image data can be transferred over a communication line 128, which could be done through the network 130 such as Internet, to the security server 136 where such alarm data from the home server 126 may be stored in the storage unit 214.

Figure 12:
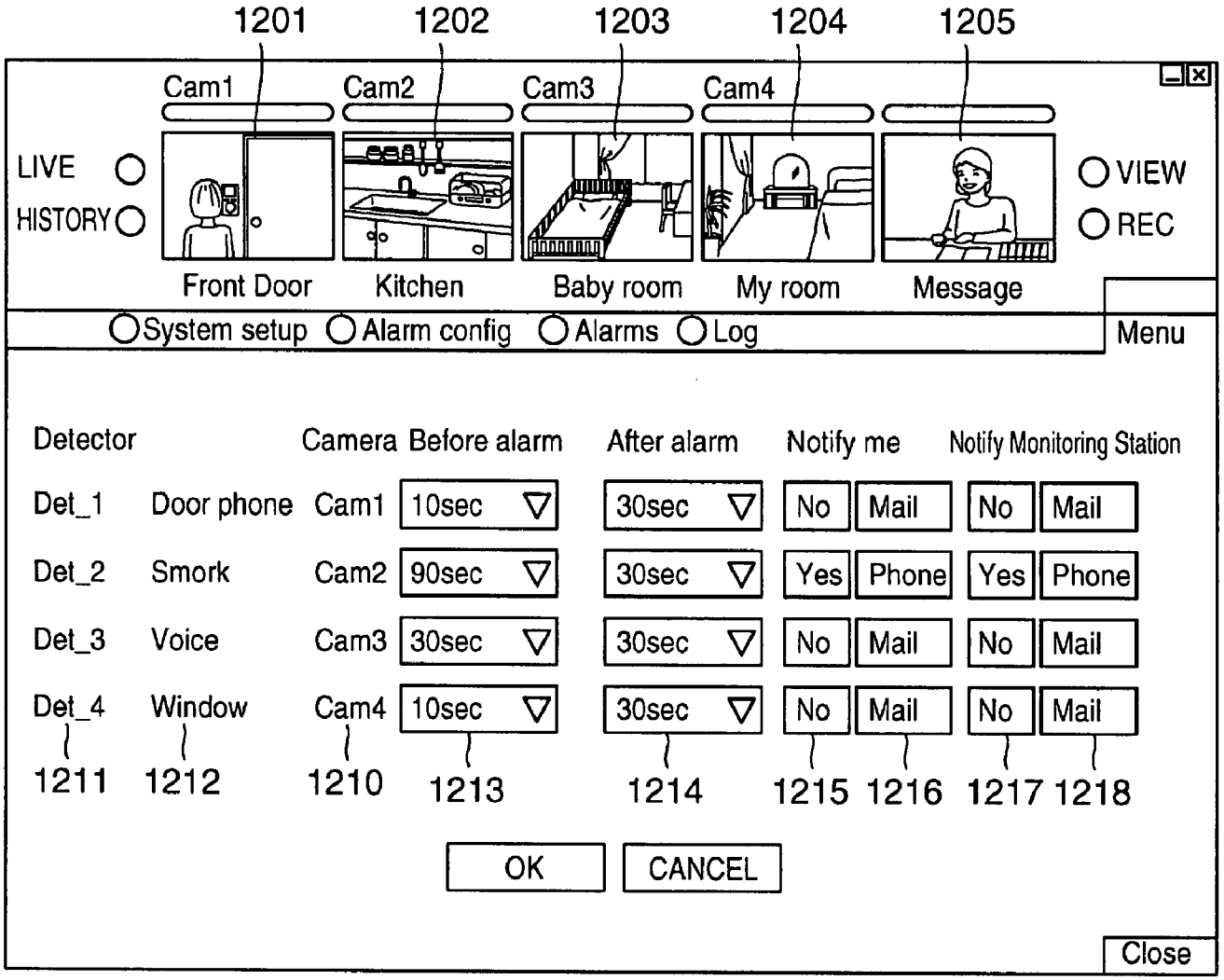
FIG. 12 is a schematic view showing an example of the GUI display utilized during the setting operation of the monitoring system of FIG. 9.

An example of the alarm notification configuration to set up buffering periods of the image data before/after the alarm and notification rules of the alarm data is described with reference to FIG. 12. FIG. 12 shows a schematic view of a GUI display on the viewing terminal 122 during the setting operation. In the setting operation, the remote control 144 may be used to input the user's instruction.

In the example shown in FIG. 12, there are five imaging units 1201–1205 represented by four cameras Cam_1, Cam_2, Cam_3, Cam_4 positioned so as to capture image from "front door", "kitchen", "baby room", "my room". There is a fifth display for "message" that may be a message sent to the home server from a remote place, for example through the network 130. Each of the cameras 110 are associated with a detector in the instant example. In the example, the detectors (sensor 112) of the system represented by "Det_1", "Det_2", "Det_3" and "Det_4" are sensing devices called "door phone", "smoke", "voice" and "window" detecting movement, smoke, noise, breaking glass, respectively. As defined in columns 1210–1212 of the figure, the detectors are associated with cameras located respectively in "front door", "kitchen", "baby room", "my room".

In addition, the period of time in which image is captured, before and after alarm, i.e., before and after activating the sensor 112, can be set independently for each camera, as shown in columns 1213, 1214 represented by "before alarm" and "after alarm". By pressing a button in the remote controller 144 corresponding to the downward arrow in the box showing the time value (for example, the box showing "10 sec" for "Det_1", the user may change the time value. The setting of the times may be performed by positioning a cursor over the display as shown in FIG. 12. Alternatively, it is also possible to provide the viewing terminal 122 as a touch panel display in which the user may adjust the settings of the system by directly touching the display.

Moreover, the system may be configured through the viewing terminal 122 in terms of whether or not and how to notify the user and/or the security service business operator (security company operating the monitoring station). In the example illustrated in FIG. 12, the settings for whether and how to notify the user is done in the columns 1215, 1216 represented by "notify me" ("me" meaning "user" from the user's point of view) and the settings whether notify the security service business provider is done in the columns 1217 represented by "notify monitoring station".

In the example, the sensor for the door phone Det_1 requires no message to be notified to both user and the monitoring station 132. As for the smoke sensor Det_2 with Cam_2 looking the kitchen, the user is to be notified by phone for immediate action ("Yes" and "Phone", standing for "notify by phone"). It is preferable to use a message prepared in advance so as to make a calling operation automatic if the telephone call is required. If mail is selected for notification, such message in text or vocal form may be sent electronically. After determining the settings, the user pushes OK for confirmation or CANCEL for resetting.

Remote Controller

The remote controller 144 may be used as an input unit for interacting with the monitoring system through the home server 126 in order to, for example:

- Configure the monitoring system;
- Specify how the system should react to alarms, i.e., for example sending an alarm notification to a security service business operator 132 through a security server 136 (both described above);
- View the image data from the cameras 112;
- View the active alarms, to take actions and to check the actions of the security server 136 and/or personnel at the monitoring station 132 associated with the security server 136.
- Log, view and manage past alarms and actions.

The remote controller 144 may preferably include a wireless device or apparatus including, for example, an infrared transmitter by which the user may input various kinds of information via transmission path 140 to control the operation of home server 126 and viewing terminal 122. Alternatively, the remote controller 144 may include an input apparatus such as a mouse for personal computers.

Keypad

Figure 13:
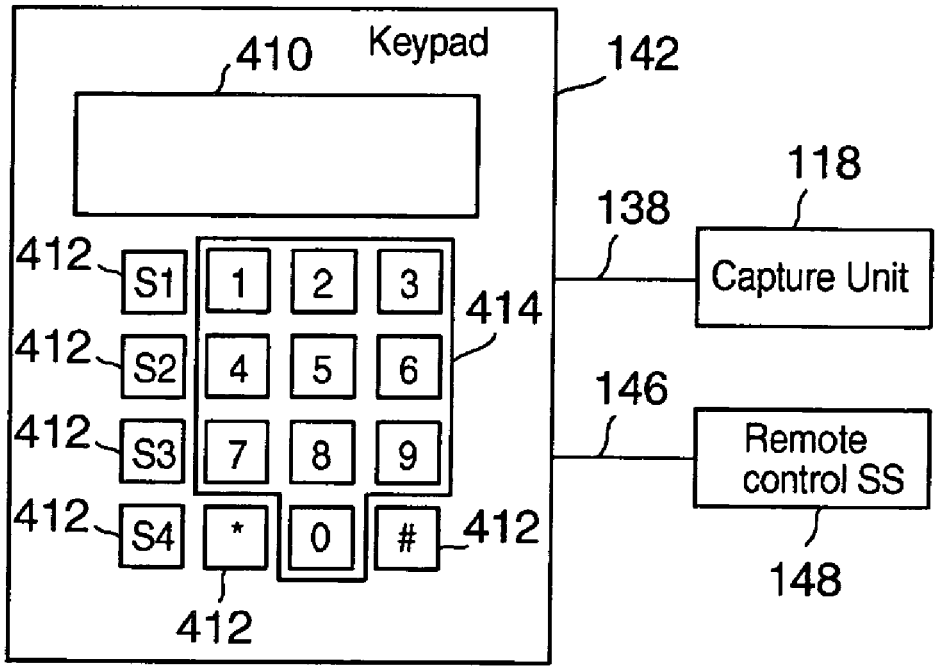
FIG. 13 is a schematic block diagram showing an example of the keypad in the monitoring system of FIG. 9.

An example of security keypad 142 according to a preferred embodiment of the present invention is shown by reference to FIG. 13. The security keypad 142 may include a display 410 such as a LCD (Liquid Crystal display); numeric buttons 414 such as a ten-key numeric keypad, and some additional buttons 412. Interaction with the keypad 142 is send to the home server 126 via the capture unit 118 and a communication link 138. The communication link 138 may be either by wire or wireless. Alternatively, the keypad 142 may be connected to the home server 126 directly to send the user's command.

The user may input commands with the keypad 142 by pressing the keys 412 and 414, and receiving feedback of the input and about the status of the monitoring system over the LCD display 410. The LCD display may show the security mode of the monitoring system and if there has been an alarm. The keypad 142 may be also used to change the security mode of the monitoring system (e.g., to arm the system or to disarm the system) and to cancel alarms.

Security Server

Figure 14:
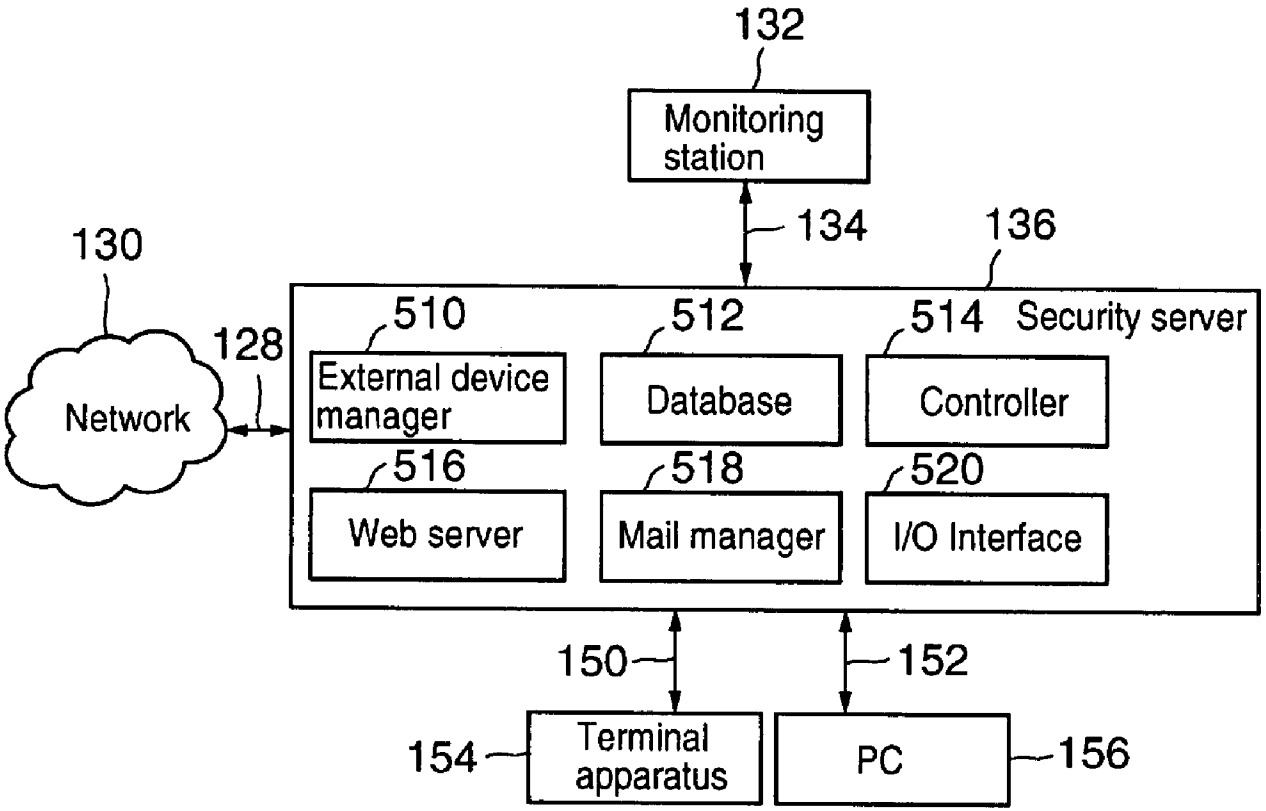
FIG. 14 is a schematic block diagram showing an example of the security server in the monitoring system of FIG. 9.

An example of a block diagram of the security server 136 is shown by reference to FIG. 14. The security server 136 of the instant example comprises a I/O interface 520 for interfacing with various external apparatuses, a controller 514 for executing the monitoring operation according to the present embodiment, and a database 512 for storing data required for the monitoring operation such as the user data, the alarm data or the like. The security server 136 further comprises an external device manager 510, a web server 516 and a mail manager 518 for alarm notification and communications with various external apparatuses.

Major functional features of the security server 136 in the present embodiment are:

- keeping of communication logs with the home server 126 and the monitoring station 132;
- storage of the alarm data transmitted from the home server 126; and
- transmission of the alarm data to destinations in accordance with the contact instruction transmitted from the home server 126.

Figure 15:
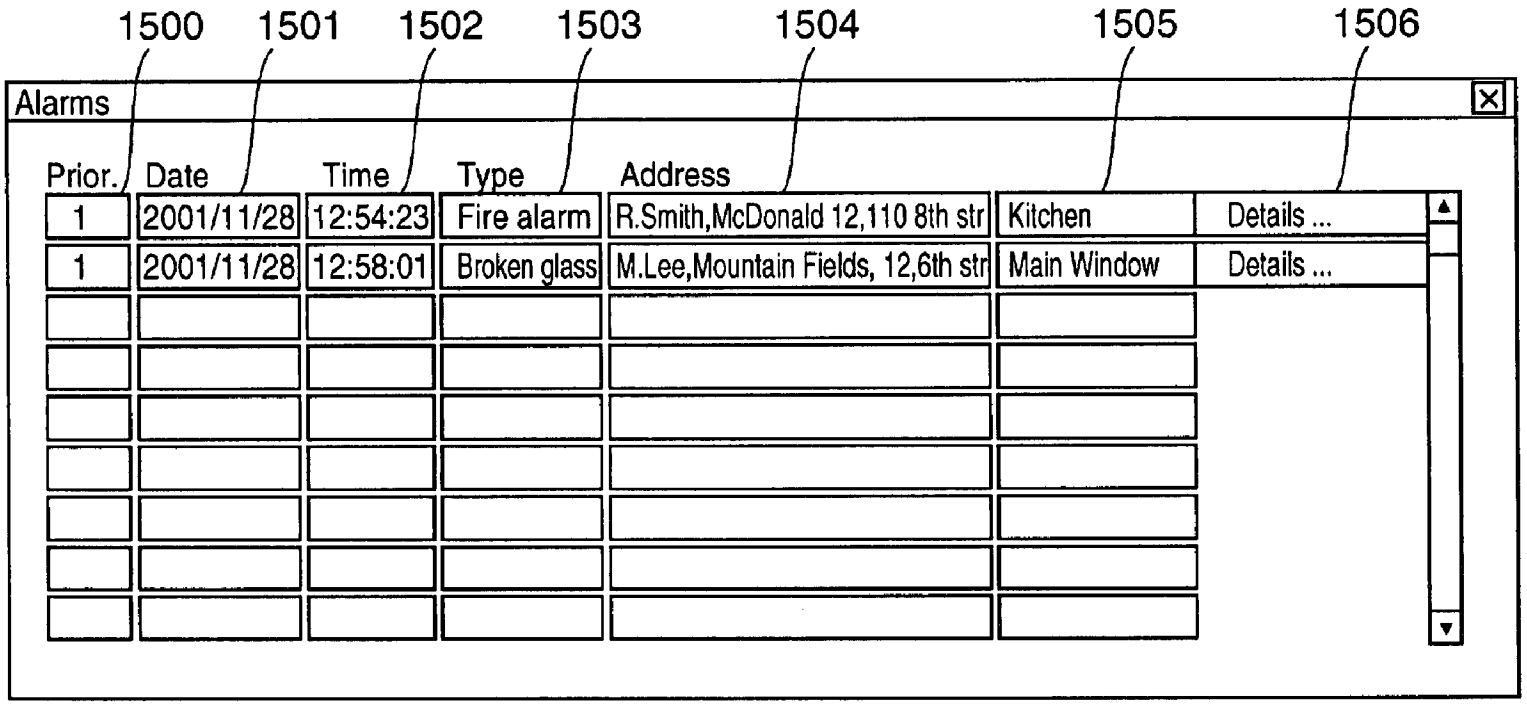
FIG. 15 is a schematic view showing an example of the communication log kept in the security server in the monitoring system of FIG. 9.

The security server 136 receives the alarm data comprising alarm notifications, corresponding image data and contact instruction from the home servers 126. The received alarm data may be logged and displayed as shown in FIG. 15 and stored in the data base 512 of the security server 136. In the instant example, it is assumed that a plurality of the home servers 126 are connected to single security server 136 via the network 130.

It is to be noted that FIG. 15 illustrates an example of data format that can be viewed on a display (not shown) of the security server 136 if such view is requested by the monitoring business operator managing the security server 136. The same data format as shown in FIG. 15 may also be used on the monitoring station 132 to view a summary of the received alarm data.

In the example of FIG. 15, the alarm notification that is displayed includes a code 1500 represented by "Prior." for indication of priority, Date 1501 and Time 1502 of the alarm data reception, an alarm Type 1503, Address 1504 of the origin of alarm or registered address related to the alarm, a specification 1505 of the location of sensor that has originated the alarm notification, and Detail 1506 of the alarm data which may include the image data and contact instruction attached in the instant alarm data.

The priority 1500 may indicate the type of action to be taken depending on this priority. In the illustrated example, priority "1" may trigger a command to send an instruction to an appropriate monitoring station 132 requesting dispatch of an agent to the local of alarm or notify a police station. A notification of lower priority (not shown), such as an electronic apparatus within the user's house that has been left turned on after the user left home may trigger a command to just notify the user or even remotely send a command to turn off the apparatus. Also, the priority code may merely serve as an indication for identifying the degree of attention or type of action to be taken by a security agent of the security service business operator against the alarm notification. For example, if the priority is low, the security agent may choose to take no action.

The date 1501 in the example of FIG. 15 has a format of yyyy/mm/dd (year/month/day), the time 1502 has a hour: min:second format. The type 1503 specifies the type of alarm such as fire alarm, broken glass, in the example illustrated in FIG. 15. Alternatively the type 1503 may be an identification code (either numeric or alphanumeric) for identifying the type of alarm within a predetermined classification group. The supplemental field 1505 after the address 1504 in the figure specifies the local of the alarm, such as Kitchen, Main Window, etc.

An example of details 1506 is an image captured by a camera 110 installed in the user's house. Such image may constitute the image data that may be transmitted along with the notification data. However, if the user sets to do so, the detailed information may be omitted. In other words, if the user has set the monitoring program at the home server 126 not to send image data, there may be no further details to show.

The alarm data that has been stored in the security server 136 may be transmitted to or accessed by the user from either the PC 156 or the terminal apparatus 154 at a remote position, through respective communication paths 152 and 150 as shown in FIG. 14. Alternatively, the communications between the security server 136 and the terminal apparatuses 154 and the PCs 156 may be done over the network 130 or Internet.

In addition, at request and setting by the user, the alarm data may be transmitted in a designated form to the monitoring station 132 at the security service business operator.

The security server 136 may provide alarm notification or the like according to the contact instructions that are provided when configuring the monitoring system and the cameras 110 and sensors 112 in FIG. 12. When an alarm data (signal) is received by the security server 136 from the home server 126, the database 512 is updated, the web server 516 is updated and mail manager 518 sends an electronic message such as an electronic mail to a concerning destination that is previously specified by the user. The security server 136 maintains the database 512 with all alarms and as well as related image, video and/or audio data.

Figure 16:
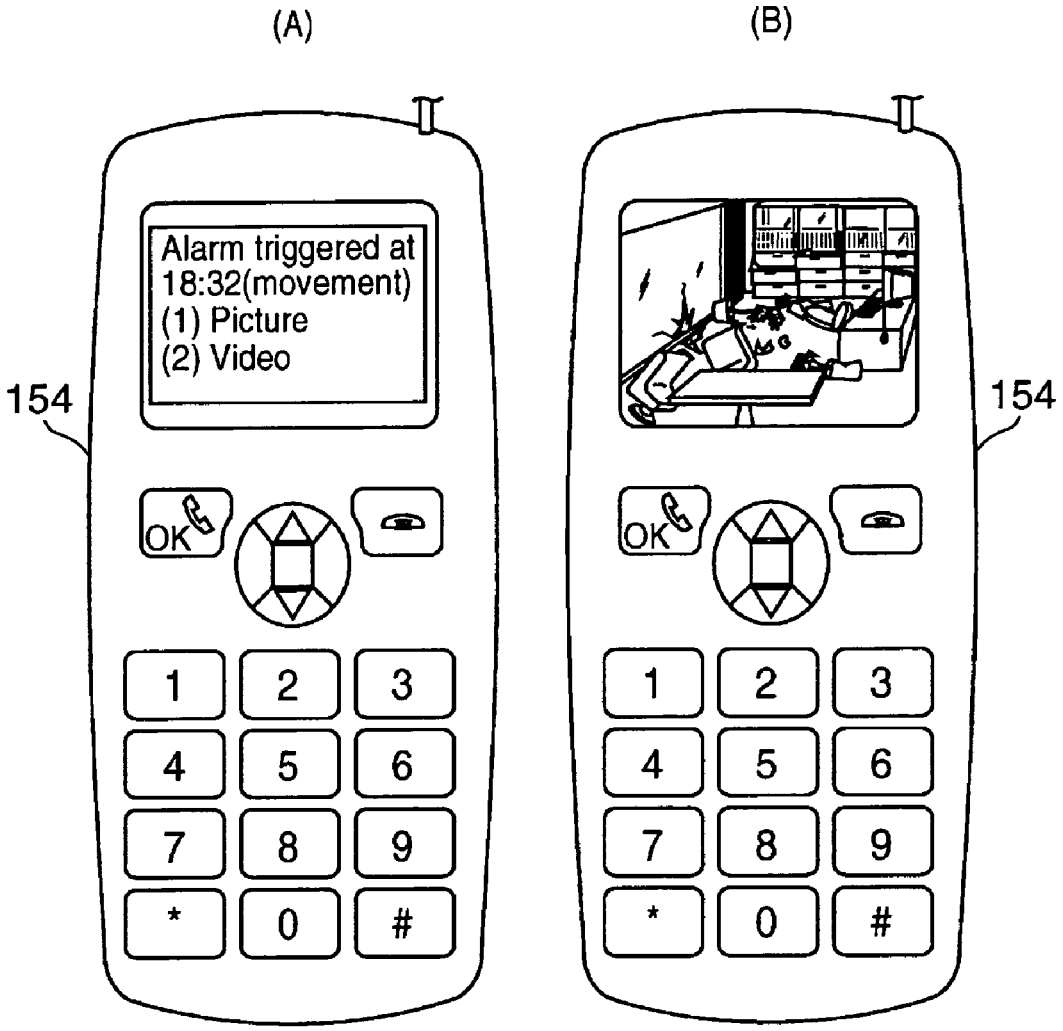
FIG. 16A and FIG. 16B are schematic views of the terminal apparatus used by the user in the monitoring system of FIG. 9.

An example of alarm notification to be sent and viewed by the user in terminal apparatus 154 is illustrated in FIG. 16A. In FIG. 16A, the terminal apparatus schematically represented by a portable terminal such as a mobile phone or a PDA (Personal Digital Assistant) shows in its display a simplified text describing the time of occurrence of alarm ("18:32") and the type of alarm (movement). It also is specified that the details in form of image data are available either in picture form or video (motion picture). FIG. 16B shows an example of image data displayed in the terminal apparatus 154, showing an image that has been captured by the camera 112 installed at user's house and corresponding to the sensor 112 to which the alarm is originated.

The user may access the security server 136 to view the alarm data when the alarm notification is received by the security server 136 or at any other time. The web server 516 of the security server 136 maintains sites that can be accessed by a plurality of users (customers) to view his/her own monitoring information (e.g., an alarm), preferably at anytime from any place. A plurality of terminal apparatuses 154 such as a mobile phone, a PDA (Personal Digital Assistant) and the PCS 156 may connect to the security server 136 over communication channels 150, 152 and access the data stored on the security server 136. The communication channels 150, 152 can be wired or wireless or may be a part of the network 130. The security server 136 converts the alarm data into a format suitable for display on the connected terminal apparatus 154 or the PC 156.

Figure 17:
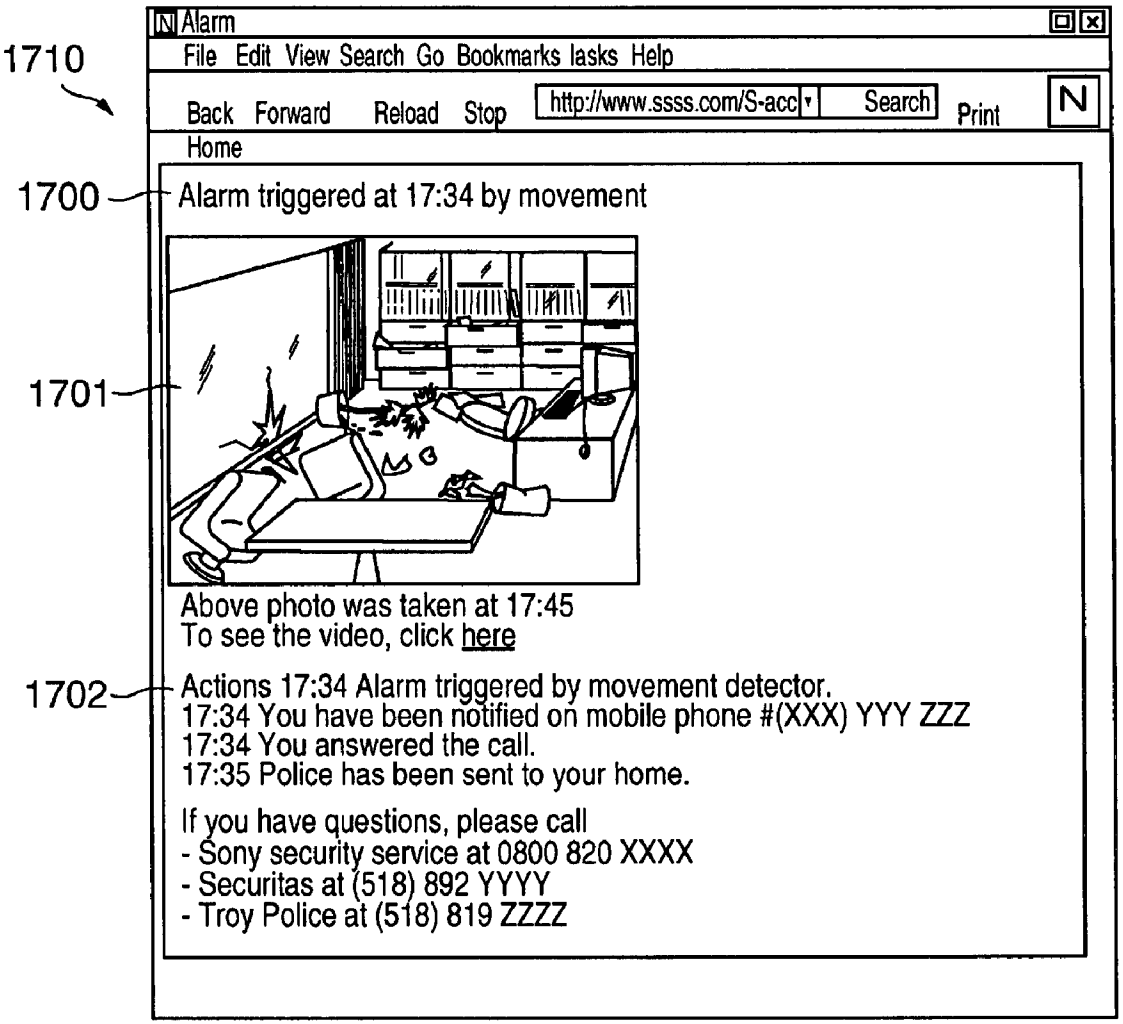
FIG. 17 is a schematic view showing an example of the web page generated by the security server and can be accessed by the user to view the alarm data in the monitoring system of FIG. 9.

An example of the web site that is managed by the security server 136 and can be accessed by the user to view the alarm data is shown in FIG. 17. The FIG. 17 shows an web page 1710 viewed by the user's PC 154. The web page 1710 shows the time and type of alarm 1700, along with a picture 1701 that has been captured by the camera 110, recorded in the home server 126 and transmitted to the security server 136. The web page displays also text data 1702 related to the alarm notification as well as actions taken at the security server 136 and the monitoring station 132.

Upon the setting of the monitoring program at the home server 126, the alarm data stored in the security server 136 as well as some additional data to identify the user may be transmitted for display at the monitoring station 132 at the security service business operator.

Figure 18:
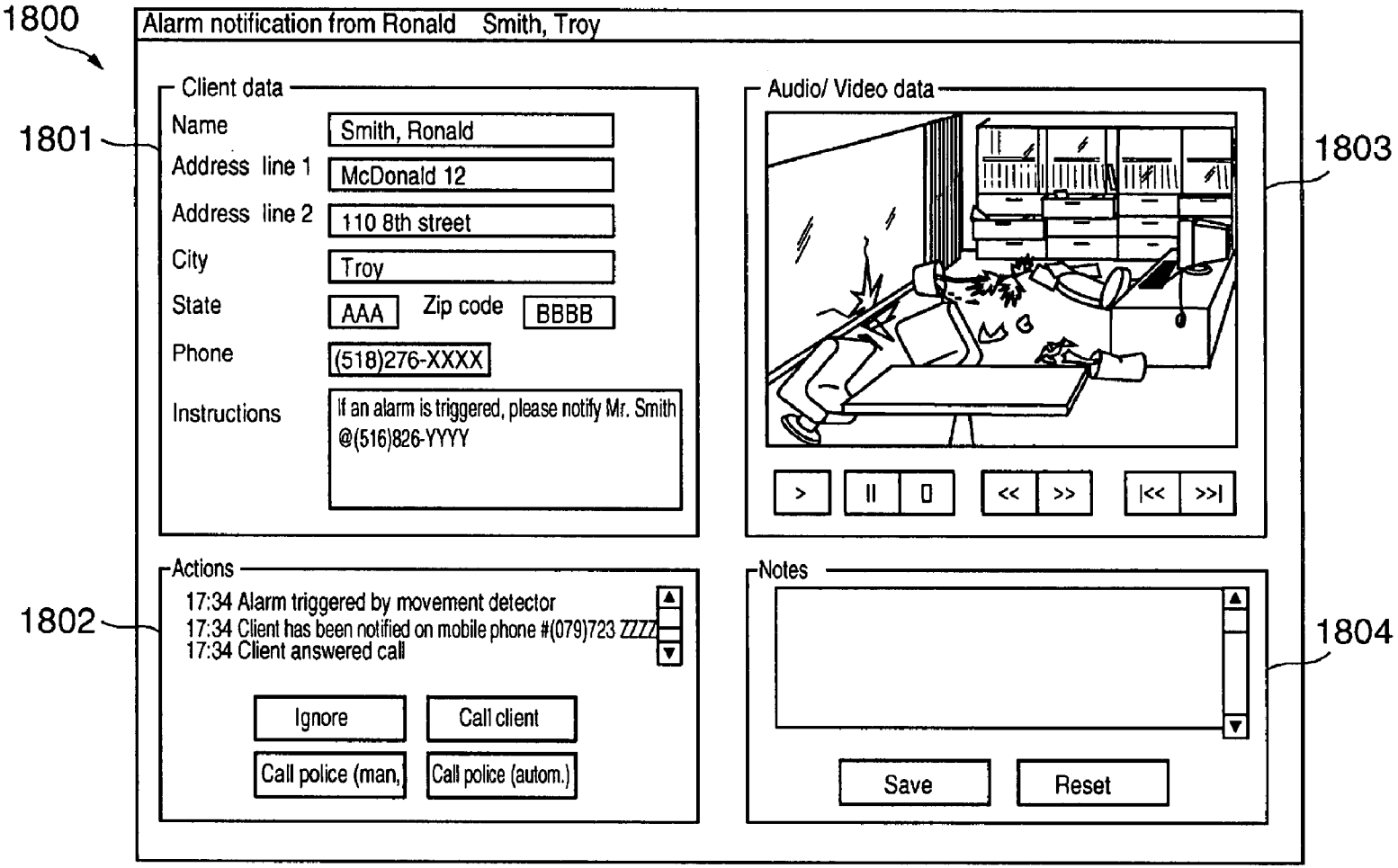
FIG. 18 is a schematic view showing an example of the alarm data transmitted from the security server to the monitoring station.

An example of a graphic user interface display in which the alarm data 1800 can be viewed at the monitoring station 132 is illustrated in FIG. 18. In one of the preferred embodiments of the present inventions, the display of FIG. 18 may be configured so as to link the Details button 1506 of the GUI display shown in FIG. 15 thereby allowing the security agent of the monitoring station 132 to view details of the alarm data if necessary.

In the example of FIG. 18, client data 1801, action data 1802 regarding actions that has been taken, and image data 1803 corresponding to the instant alarm are displayed for review by the security service business operator and a Notes field 1804 for storing comments by the security service business operator regarding the instant alarm is provided. The client data 1801 may include Name, Address, Phone number for contact and specified instructions to be taken by the security service business operator. The action data 1802 includes specification of the event that caused the alarm, comments on whether the client (user) has been notified and whether he/she has answered the call. The image data 1803 shows audio/image data that corresponds to the instant alarm data. In this case, it is presumed that the user has previously set the monitoring program at the home server 126 so as to allow the image data to be sent to the security server 136 and further to the monitoring station 132. There are also displayed function buttons to control reproduction of the image, in case the image data includes motion picture.

It is to be noted that the user utilizing the monitoring system of the present embodiment does not interact with the monitoring station 132 directly but only over the security server 136. The monitoring station 132 typically may include a computer system located at a security service business operator (not shown), for example, on which a dedicated security application is executed.

In addition, as the database that stores the alarm data is located in the security server 136, which is not located at the security service business operator, it is possible to provide a monitoring service independent from the security service business operator who provides conventional security service that takes action in the event of an alarm, such as moving to the site so as to investigate the causes of the alarm.

As already mentioned above, this may provide a flexibility of the service in which the user may change the security service business operator without having to cancel the existing data and registration at the security server 136. In the event of changing the security service business operator, i.e., the monitoring station 132 to which the alarm data is transmitted, the user has just to change or make a request for changing settings of the monitoring program that already has all necessary data inputted therein including profile data of the user, system hardware, program setup, charging method, etc. This avoids the burden of re-entering the user data whenever the user changes the security service business operator. Also, the user may have the flexibility to select a plurality of security service business operators.

Monitoring System: Third Preferred Embodiment

Figure 19:
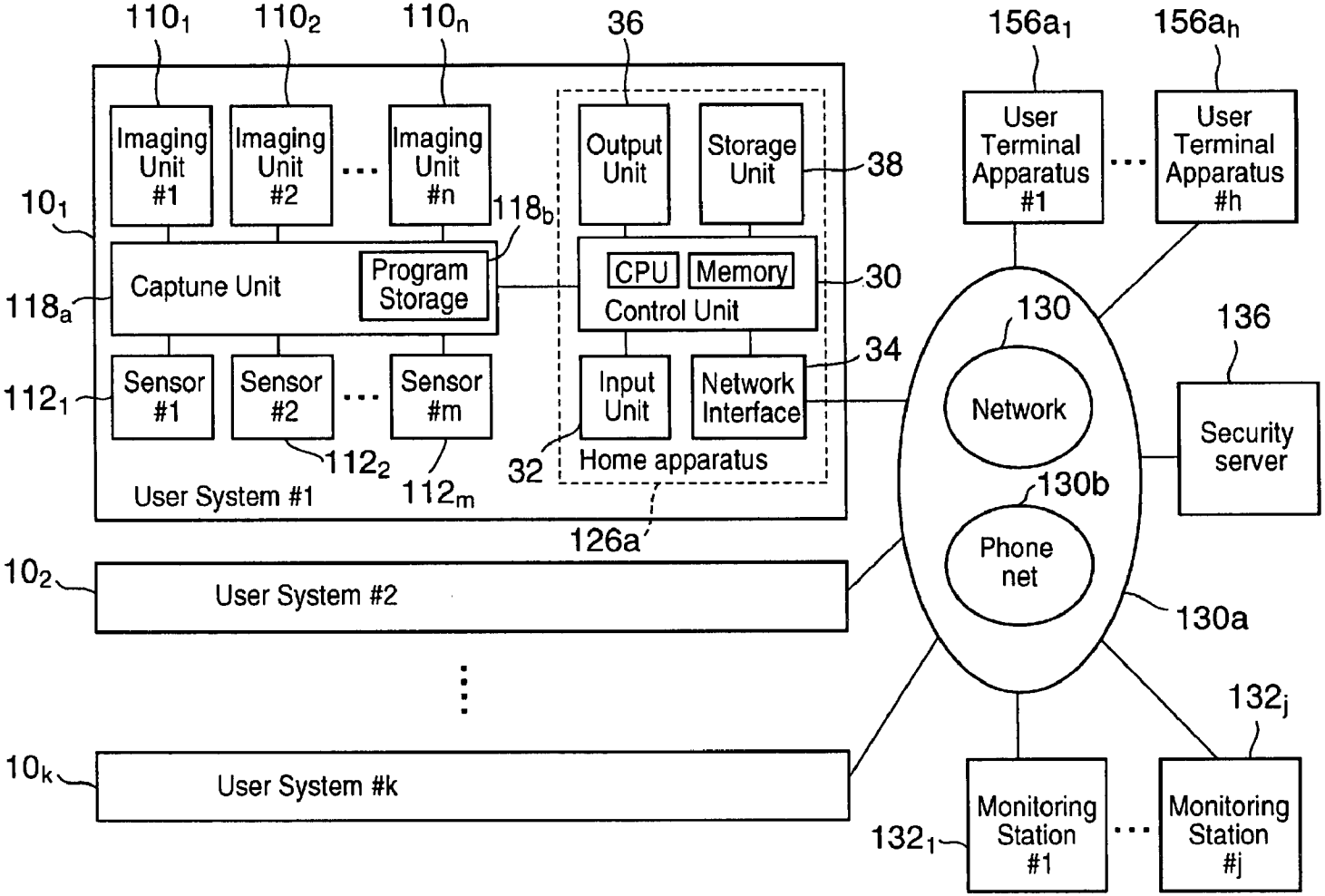
FIG. 19 is a schematic block diagram showing an example of the monitoring system according to a third preferred embodiment of the present invention.

A monitoring system according to a third preferred embodiment of the present invention is illustrated in the block diagram of FIG. 19. Blocks corresponding to functions or portions similar to the first or second preferred embodiments described above are indicated with the same numerals and description thereof is omitted in order to avoid redundancy.

In the present embodiment, a plurality of user systems $\mathbf{10}_1$–$\mathbf{10}_k$ are connected to single security server 136 via a network 130 and/or phone net (called communication network hereafter) 130*a*. The security server 136 transmits the alarm data to any of a plurality of monitoring stations $\mathbf{132}_1$–$\mathbf{132}_j$ and user terminal apparatuses $\mathbf{156}a_1$–$\mathbf{156}a_h$ via the communication network 130*a*.

The security server 136, each of the monitoring stations 132 functions similarly as those in the embodiments described above. The user terminal apparatus 156*a* may be the terminal apparatus 156 and the PC 154 in the second preferred embodiment.

Each of the user system 10 comprises a plurality of imaging units $\mathbf{110}_1$–$\mathbf{110}_n$, a plurality of sensors $\mathbf{112}_1$–$\mathbf{112}_m$, a capture unit 118*a* and a home apparatus 126*a*. The imaging units 110 and the sensor 112 may be the same devices as described in the previous embodiments. It is to be noted that the number of the imaging unit 110 and the sensor 112 are not necessary to be the same in different user's systems.

In the present embodiment, the home apparatus 126*a* functions as the home server 126 described above. The home apparatus 126*a* may be of any arbitrary configuration as far as it has adequate data processing capability for executing the setting and monitoring operations such as ones illustrated in FIGS. 5 and 6. For example, instead of being realized as a unit having the specific purpose for the monitoring system of the present invention, the home apparatus may include a processor of general purpose, such as a personal computer or game console having processing capability.

The home apparatus 126*a* may comprise a control unit 30 including CPU and memory to run the setting and monitoring programs according to the present invention, an input unit 32, a network interface 34, an output unit 36 and a storage unit 38. The storage unit 38 utilized for recording alarm data may be a storage medium available in an apparatus such as a storage medium available in a personal computer, a hard disk drive, a video tape recorder, a camcorder, a game console, an entertainment robot, etc.

If such processor of non-dedicated apparatus is to be used to run the setting and the monitoring programs realizing the monitoring system of the present invention, the setting and the monitoring programs may be pre-installed in a program storage 118*b* provided in the capture unit 118*a* to be sold. If the user purchase such capture unit 118*a* pre-installed with the setting and monitoring program, the purchased capture unit 118*a* may be connected to the home apparatus 126 to download the setting and monitoring programs to realize the user's system 10. It is preferred to have the monitoring programs with a Universal plug-and-play (UPnP) format.

Alternatively, such setting and monitoring programs may be distributed over the network 130 or by storage medium such as magnetic disk, optical disk, or the like so as to install into an appropriate home apparatus 126*a*. In this case, no program storage 118*b* is required in the capture unit 118*a*.

Finally, although the present invention has been described in detail with a certain degree of particularity with reference to specific preferred embodiments of the present invention, it is to be understood by those skilled in the art that such preferred embodiments have been presented for illustrative purposes for the invention in its preferred form. Accordingly, the description herein is not restrictive as to the presented preferred embodiments and any modifications, variations, combinations and sub-combinations may be practiced otherwise than as specifically described herein without departing from the scope of the present invention.

For instance, the security server 126, which may be typically administrated by a monitoring business provider, has been described as a single apparatus or system. However, it is possible to provide a configuration in which there are two or more similar security servers separated according to criteria like geographical distribution of users, volume of data, time, classification of users, type of event causing alarm (intrusion, accident, telephone call, visits, etc.).

Also, the displays and layouts for the system settings, the keypad, the remote controllers, the terminal apparatuses at the user side, the monitoring stations may be of layouts and format different from what has been presented above.

Moreover, functional units described in the block diagrams as been separated may be actually realized as a same physical unit or apparatus. Conversely, functions that have been described above as been included in a same functional block may be separated in different blocks or be incorporated in other blocks.

In addition the network interfaces and data interfaces between servers and apparatus transmitting data through the communication networks may include converters available in existing modems, routers, communication hubs or server units utilized in combination with purposes and functions other than specifically described for the preferred embodiments of the present invention.

Although the description of the present monitoring system having been made focused on an application for home or household security against intruders, violation of private property such as robbing or theft, security monitoring and alarm against gas leakage, fire, smoke or the like, it is possible to apply the embodiments of present invention for monitoring activity such as movement in the house when elderly or physically and/or psychologically challenging people, infants, children or pets are left in the house, so that the activity may be, for example, constantly monitored or alarm may be triggered if a designated object is touched or activated, such as inadvertent activation of electronic appliances, falling objects, broken objects, voice or sound level above a predetermined level (crying, etc.) or the like.

Especially in case of the elderly or disabled people, the application of the present invention may be significant for social welfare purposes other than for simple home security purposes. For example, a switch that is conventionally set in a hot water pot may serve as a sensor for detecting activation of the house appliance. If the time period between one activation of the hot water pot and the next activation exceed a predetermined period of time (for example, 6 hours), an alarm signal may indicate an abnormality, as the person may have stopped normal life activity within the house. Likewise, a sensor may be installed to detect utilization of resources that are presumed essential for life activity within a house, such as utilization of water or light within the house, so that the sensors or the preferred embodiments of the present invention may include switches, sensors, devices or apparatuses already existing for other purposes instead of dedicated apparatuses for the only purpose of monitoring.

Furthermore, according to the presenting invention, it is possible to keep the security data and other private information related to the user including personal data under strict control of a trustful party, or to send the security data and other private information only if they are required.

What is claimed is:

1. A monitoring method for a system including a plurality of sensors, a plurality of imaging units and a storage unit, the monitoring method comprising:

receiving outputs from the plurality of sensors and the plurality of imaging units; and transmitting a notification signal to a preset destination if one of the received outputs corresponds to an alarm status; wherein the notification signal includes image data outputted from at least one among the plurality of imaging units associated with the sensor corresponding to the alarm status; and the association among the plurality of sensors and the plurality of imaging units is determined and stored in the storage unit in accordance with a user's input.

2. The monitoring method according to claim 1 wherein the previously defined alarm criterion includes at least one of classification of the alarm status, a procedure to be taken against the alarm, priority of the alarm over others and degree of relevance thereof.

3. A computer program realizing one of the methods according to claim 1.

4. A storage medium storing a computer program to realize one of the methods according to claim 1.

5. A storage medium storing a computer program to realize the method according to claim 1.

6. A monitoring method for a system including a plurality of sensors and a storage unit, the monitoring method comprising:

receiving outputs from the plurality of sensors;

transmitting a notification signal to a preset destination if one of the received outputs corresponds to an alarm status requiring notification, based on a previously defined alarm criterion; wherein the notification signal includes contact instruction information that defines whether another notification signal corresponding to the notification signal is transmitted to another destination from the preset destination receiving the notification signal; and the contact instruction information is generated based on a notification rule that is determined in accordance with a user's input and stored in the storage unit.

7. The monitoring method according to claim 6, wherein:

the other destination to which the other notification signal is transmitted is selected in accordance with a user's input and stored in the storage unit.

8. The monitoring method according to claim 6 wherein the previously defined alarm criterion includes at least one of classification of the alarm status, a procedure to be taken against the alarm, priority of the alarm over others and degree of relevance thereof.

9. A computer program realizing the method according to claim 6.

10. A storage medium storing a computer program to realize the method according to claim 6.

11. A monitoring method for a system including a plurality of sensors, a plurality of imaging units and a storage unit, the monitoring method comprising:

receiving output from the plurality of sensors and the plurality of imaging units; and transmitting a notification signal to a preset destination if one of the received output signals corresponds to alarm status; wherein the notification signal includes image data from at least one among the plurality of imaging units associated with the sensor corresponding to the alarm status and a contact instruction information that defines whether another notification signal corresponding to the notification signal is further transmitted to another destination from the preset destination receiving the notification signal; and the association among the plurality of sensors and the plurality of imaging units, the contact instruction information and the other destination are generated based on notification rule that is determined in accordance with a user's input and stored in the storage unit.

12. The monitoring method according to claim 11 wherein the previously defined alarm criterion includes at least one of classification of the alarm status, a procedure to be taken against the alarm, priority of the alarm over others and degree of relevance thereof.

13. A computer program realizing the method according to claim 11.

14. A storage medium storing a computer program to realize the method according to claim 11.

15. A monitoring method for monitoring activity in a preset location by using a plurality of sensors and transmitting a notification signal if one of the plurality of sensors captures a signal corresponding to an alarm status, the monitoring method comprising:

a monitoring step and a setting step for setting the monitoring step;

(1) the setting step including:

registering a plurality of sensors and a plurality of imaging units to be used in the monitoring step;

setting a logical connection between an imaging unit among the plurality of imaging units to a sensor among the plurality of sensors; and storing the logical connection in a storage unit, (2) the monitoring step including:

receiving outputs from the plurality of sensors and the plurality of imaging units; and transmitting the notification signal to a preset destination if one of the received output signals corresponds to the alarm status, the notification signal including image data from an imaging unit and a sensor corresponding to the logical connection corresponding to tho alarm status; wherein (3) the monitoring method further comprising:

receiving a user's input for changing the logical connection stored in the storage unit.

16. The monitoring method according to claim 15, further comprising:

setting notification rule for determining another destination other than the preset destination and content of the notification signal;

storing the notification rule in the storage unit; and receiving a user's input for changing the notification rule stored in the storage unit.

17. The monitoring method according claim 15 wherein the previously defined alarm criterion includes at least one of classification of the alarm status, a procedure to be taken against the alarm, priority of the alarm over others and degree of relevance thereof.

18. A computer program realizing the method according to claim 15.

19. A storage medium storing a computer program to realize the method according to claim 15.

20. A method of assisting monitoring activity performed in a designated location using a plurality of sensors, and transmitting a notification signal if one among the plurality of sensors senses an alarm status, the method being performed by a server disposed in a separate location from the designated location, the method comprising:

receiving the notification signal including contact instruction information transmitted from the designated location;

generating another notification information corresponding to the received notification signal;

determining another destination of the other notification signal based on the received contact instruction information; and transmitting the other notification signal to the determined other destination.

21. The method according to claim 20, wherein the other destination includes at least one of a user, a monitoring station designated by the user and another destination designated by the user.

22. The method according to claim 20, wherein:

the other destination includes either one among the monitoring stations, the monitoring stations including at least two monitoring stations that are operated by different security service business operators from each other.

23. A computer program realizing the method according to claim 20.

24. A storage medium storing a computer program to realize the method according to claim 20.

25. A monitoring system including a plurality of sensors, a plurality of imaging units, a control unit for determining if a notification signal should he transmitted and a transmission unit transmitting the notification signal to a preset destination, the monitoring system comprising:

a storage unit storing logical connections among the plurality of sensors and the plurality of imaging units; and a setup unit receiving a user's input and setting the logical connections in accordance with the received user's input; wherein the control unit generates the notification signal if one of the plurality of sensors is in alarm status, and determines if the notification signal includes image data outputted from the imaging unit that is logically connected to the sensor in the alarm status, and the transmission unit transmits the notification signal as determined by the control unit.

26. The monitoring method according claim 25 wherein the previously defined alarm criterion includes at least one of classification of the alarm status, a procedure to be taken against the alarm, priority of the alarm over others and degree of relevance thereof.

27. A monitoring system including a plurality of sensors, a plurality of imaging units, a control unit for determining if a notification signal should be transmitted and a transmission unit transmitting the notification signal to a preset destination, the monitoring system comprising:

a storage unit storing notification rule that is used to generate contact instruction information defining if another notification signal corresponding to the notification signal is further transmitted to another destination from the preset destination; and a setup unit receiving a user's input and setting the notification ride in accordance with the received user's input; wherein the control unit generates the notification signal if one among the plurality of sensors corresponds to alarm status, and generates the contact instruction information for the generated notification signal; and the transmission unit transmits the notification signal including the contact instruction information to the preset destination.

28. The monitoring system according to claim 27, wherein:

the other destination to which the another notification signal is transmitted is pre-selected in accordance with a user's input and stored in the storage unit.

29. The monitoring method according to claim 27 wherein the previously defined destination and the other destination to which the another notification signal is transmitted is determined according to at least one of classification of the alarm status, a procedure to be taken against the alarm, priority of the alarm over others and degree of relevance thereof.

30. The monitoring system according to claim 27, wherein:

the other destination to which the other notification signal is transmitted is pre-selected in accordance with a user's input and stored in the storage unit.

31. A monitoring system including a plurality of sensors, a plurality of imaging units, a first server for determining if a notification signal should he transmitted and transmitting the notification signal to a preset destination, the monitoring system comprising:

an input unit accepting user's input; and a capture unit receiving outputs from the plurality of sensors and the plurality of imaging units and transmitting the received outputs to the first server; wherein the first server comprises;

a storage unit storing logical connections among the plurality of sensors and the plurality of imaging units;

a setup unit receiving a user's input front the input unit and setting the logical connections in accordance with the received user's input;

a control unit generates the notification signal if one of the plurality of sensors is of alarm status; and a transmission unit transmitting the notification signal to a preset destination; wherein the control unit determines if the notification signal includes image data outputted from the imaging unit that is logically connected to the sensor of the alarm status; and the transmission unit transmits the notification signal as determined by the control unit.

32. The monitoring system according to claim 31, wherein:

the storage unit further stores notification rule that is used to generate contact instruction information defining if another notification signal corresponding to the notification signal is further transmitted to another destination from the preset destination; and the setup unit further sets the notification rule in accordance with the received user's input;

the control unit further generates the contact instruction information for the generated notification signal; and the transmission unit transmits the notification signal including the contact instruction information to the preset destination.

33. The monitoring method according to claim 32 wherein the previously defined destination and the other destination to which the another notification signal is transmitted is determined according to at least one of classification of the alarm status, a procedure to be taken against the alarm, priority of the alarm over others and degree of relevance thereof.

34. The monitoring system according to claim 32, further comprising:

a second server, which is the preset destination, receiving the notification signal, generating another notification signal based on the received notification signal, and transmitting the generated other notification signal to the other destination in accordance with the contact instruction information received with the notification signal.

35. The monitoring system according to claim 34, wherein:

the second server transmits the other notification signal with the image data that is received with the notification signal to the other destination.

36. The monitoring system according claim 31, wherein:

the other destination to which the other notification signal is transmitted includes at least one of a user, a monitoring station selected by the user and another destination designated by the user.

37. The monitoring system according to claim 36, wherein:

the other destination includes one of the monitoring stations, the monitoring stations including at least two monitoring stations that are operated by different security service business operators from each other.

38. A capture unit connected to a plurality of sensors, a plurality of imaging units and an apparatus having a computer, the capture unit including:

a receiving section receiving parallel data from the plurality of sensors and the plurality of imaging units;

a buffer storing at least a part of image data outputted from the plurality of imaging units; and a transmitting section for transmitting serial data to the apparatus, the serial data corresponding to the received parallel data.

39. A server for receiving a notification signal from a plurality of user's monitoring apparatuses, the server comprising:

a receiving unit receiving notification signals from the plurality of user's apparatuses, each of the notification signals including contact instruction information that defines if another notification signal corresponding to the received notification signal is transmitted to another destination;

a processor generating the other notification if the notification signal is received, analyzing the contact instruction information included in the received notification signal, and determining the other destination to which the generated other notification signal is transmitted in accordance with the analysis result; and a transmission unit, transmitting the other notification signal to the determined other destination.

40. The server according to claim 39, wherein the other notification signal includes image data included in the received notification signal.

41. The sewer according to claim 39, further comprising:

a web server unit for generating a web page in a network so as to allow an authorized person's viewing of image data included in the received notification signal.

42. The server according to claim 41, further comprising:

a storage unit for storing date and time in which the receiving unit receives the notification signal.

43. The server according to claim 42, wherein:

the storage unit further stores charging data for each of the user's monitoring apparatus for use of service provided by the present server, and the processor updates the charging data in accordance with communications to the user's monitoring apparatus.

44. The server according to claim 43, wherein:

the charging data includes charging amount calculated based on a number of times the receiving unit receives the notification signal.

45. The server according to claim 43, wherein:

the charging data includes charging amount calculated based on period of time spent by the receiving unit to receive the notification signal.

46. The server according to claim 43, wherein:

the charging data includes charging amount calculated based on a number of times the transmission unit transmits the other notification signal.

47. The server according to claim 43, wherein:

the charging data includes charging amount calculated based on period of time spent by the transmission unit to transmit the other notification signal.

48. The server according to claim 43, wherein:

the charging data includes charging amount calculated based on data volume of at least one of the received notification signal and the transmitted other notification signal.

49. The server according to claim 39, wherein the destination to which said generated other notification signal and the other destination to which the another notification signal is transmitted is determined according to at least one of classification of the alarm status, a procedure to be taken against the alarm, priority of the alarm over others and degree of relevance thereof.

50. A monitoring system including a plurality of sensors, a plurality of imaging units, a control unit for determining if a notification signal should be transmitted and a transmission unit transmitting the notification signal to a preset destination, the monitoring system comprising:

a capture unit, which is connected to the plurality of sensors and the plurality of imaging units, for receiving parallel data from the plurality of sensors and the plurality of imaging units and transmitting serial data that corresponds to the received parallel data to the control unit;

a storage unit storing notification rule that is used to generate contact instruction information defining if another notification signal corresponding to the notification signal is further transmitted to another destination from the preset destination; and a setup unit receiving a user's input and setting the notification rule in accordance with the received user's input; wherein the control unit generates the notification signal if one of the plurality of sensors is in alarm status, and generates the contact instruction information for the generated notification signal; and the transmission unit transmits the notification signal including the contact instruction information to the preset destination.

* * * * *